US007761290B2

(12) United States Patent
Koishida et al.

(10) Patent No.: US 7,761,290 B2
(45) Date of Patent: Jul. 20, 2010

(54) FLEXIBLE FREQUENCY AND TIME PARTITIONING IN PERCEPTUAL TRANSFORM CODING OF AUDIO

(75) Inventors: Kazuhito Koishida, Redmond, WA (US); Sanjeev Mehrotra, Kirkland, WA (US); Wei-Ge Chen, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 665 days.

(21) Appl. No.: 11/764,134

(22) Filed: Jun. 15, 2007

(65) Prior Publication Data

US 2008/0312759 A1 Dec. 18, 2008

(51) Int. Cl.
*G10L 19/02* (2006.01)

(52) U.S. Cl. ..... 704/222; 704/230

(58) Field of Classification Search ..... 704/222, 704/230

See application file for complete search history.

(56) References Cited

U.S. PATENT DOCUMENTS

| | | | |
|---|---|---|---|
| 5,040,217 | A | 8/1991 | Brandenburg et al. |
| 5,079,547 | A | 1/1992 | Fuchigama et al. |
| 5,260,980 | A | 11/1993 | Akagiri et al. |
| 5,268,685 | A | 12/1993 | Fujiwara |
| 5,295,203 | A | 3/1994 | Krause et al. |
| 5,319,714 | A | 6/1994 | Blonstein et al. |
| 5,325,215 | A | 6/1994 | Shibata et al. |
| 5,357,594 | A | 10/1994 | Fielder |
| 5,379,351 | A | 1/1995 | Fandrianto et al. |
| 5,388,181 | A | 2/1995 | Anderson et al. |
| 5,394,473 | A | 2/1995 | Davidson |
| 5,438,643 | A | 8/1995 | Akagiri et al. |
| 5,455,874 | A | 10/1995 | Ormsby et al. |
| 5,539,829 | A | 7/1996 | Lokhoff et al. |
| 5,581,653 | A | 12/1996 | Todd |
| 5,590,066 | A | 12/1996 | Ohki |
| 5,627,938 | A | 5/1997 | Johnston |
| 5,640,486 | A | 6/1997 | Lim |
| 5,654,702 | A | 8/1997 | Ran |

(Continued)

FOREIGN PATENT DOCUMENTS

| | | |
|---|---|---|
| CA | 2452343 | 1/2003 |

(Continued)

OTHER PUBLICATIONS

Search Report from PCT/US04/24935, dated Feb. 24, 2005.

(Continued)

*Primary Examiner*—Abul Azad
(74) *Attorney, Agent, or Firm*—Klarquist Sparkman, LLP

(57) ABSTRACT

An audio encoder/decoder performs band partitioning for vector quantization encoding of spectral holes and missing high frequencies that result from quantization when encoding at low bit rates. The encoder/decoder determines a band structure for spectral holes based on two threshold parameters: a minimum hole size threshold and a maximum band size threshold. Spectral holes wider than the minimum hole size threshold are partitioned evenly into bands not exceeding the maximum band size threshold in size. Such hole filling bands are configured up to a preset number of hole filling bands. The bands for missing high frequencies are then configured by dividing the high frequency region into bands having binary-increasing, linearly-increasing or arbitrarily-configured band sizes up to a maximum overall number of bands.

21 Claims, 10 Drawing Sheets

U.S. PATENT DOCUMENTS 5,661,755 A 8/1997 Van De Kerkhof et al.
5,682,461 A 10/1997 Silzle et al.
5,686,964 A 11/1997 Tabatabai et al.
5,737,720 A 4/1998 Miyamori et al.
5,777,678 A 7/1998 Ogata et al.
5,812,971 A 9/1998 Herre
5,819,214 A 10/1998 Suzuki et al.
5,845,243 A 12/1998 Smart et al.
5,848,391 A 12/1998 Bosi et al.
5,852,806 A 12/1998 Johnston et al.
5,870,480 A 2/1999 Griesinger
5,886,276 A 3/1999 Levine et al.
5,956,674 A 9/1999 Smyth et al.
5,970,173 A 10/1999 Lee et al.
5,974,380 A 10/1999 Smyth et al.
5,987,406 A * 11/1999 Honkanen et al. ..... 704/220
5,995,151 A 11/1999 Naveen et al.
5,995,539 A 11/1999 Miller
6,021,386 A 2/2000 Davis et al.
6,029,126 A 2/2000 Malvar
6,058,362 A 5/2000 Malvar
6,073,153 A 6/2000 Malvar
6,115,688 A 9/2000 Brandenburg et al.
6,115,689 A 9/2000 Malvar
6,122,607 A 9/2000 Ekudden et al.
6,154,762 A 11/2000 Malvar
6,167,093 A 12/2000 Tsutsui et al.
6,182,034 B1 1/2001 Malvar
6,226,616 B1 5/2001 You et al.
6,230,124 B1 5/2001 Maeda
6,240,380 B1 5/2001 Malvar
6,301,304 B1 10/2001 Jing et al.
6,311,154 B1 10/2001 Gersho et al.
6,324,560 B1 11/2001 Malvar
6,341,165 B1 1/2002 Gbur et al.
6,363,117 B1 3/2002 Kok
6,370,502 B1 4/2002 Wu et al.
6,377,916 B1 * 4/2002 Hardwick ..... 704/208
6,393,392 B1 5/2002 Minde
6,449,596 B1 9/2002 Ejima
6,473,534 B1 10/2002 Merhav et al.
6,487,574 B1 11/2002 Malvar
6,496,795 B1 12/2002 Malvar
6,498,865 B1 12/2002 Brailean et al.
6,507,614 B1 1/2003 Li
6,601,032 B1 7/2003 Surucu
6,636,830 B1 10/2003 Princen et al.
6,680,972 B1 1/2004 Liljeryd
6,687,726 B1 2/2004 Schneider
6,694,342 B1 2/2004 Mou
6,701,019 B1 3/2004 Wu et al.
6,728,317 B1 4/2004 Demos
6,735,567 B2 5/2004 Gao et al.
6,760,698 B2 7/2004 Gao
6,766,293 B1 7/2004 Herre
6,771,777 B1 8/2004 Gbur et al.
6,778,709 B1 8/2004 Taubman
6,804,643 B1 10/2004 Kiss
6,882,685 B2 4/2005 Malvar
6,882,731 B2 4/2005 Irwan et al.
6,934,677 B2 8/2005 Chen et al.
6,999,512 B2 2/2006 Yoo et al.
7,010,041 B2 3/2006 Graziani et al.
7,043,423 B2 5/2006 Vinton et al.
7,062,445 B2 6/2006 Kadatch
7,107,211 B2 9/2006 Griesinger
7,193,538 B2 3/2007 Craven et al.
7,310,598 B1 12/2007 Mikhael et al.
7,325,023 B2 1/2008 Youn
7,447,631 B2 * 11/2008 Truman et al. ..... 704/230
2001/0017941 A1 8/2001 Chaddha
2002/0116199 A1 8/2002 Wu et al.
2003/0093271 A1 5/2003 Tsushima et al.
2003/0103679 A1 6/2003 Etoh et al.
2003/0115041 A1 6/2003 Chen et al.
2003/0115042 A1 6/2003 Chen et al.
2003/0115050 A1 6/2003 Chen et al.
2003/0115051 A1 6/2003 Chen et al.
2003/0115052 A1 6/2003 Chen et al.
2003/0193900 A1 10/2003 Zhang et al.
2003/0233234 A1 12/2003 Truman et al.
2003/0233236 A1 12/2003 Davidson et al.
2003/0236580 A1 12/2003 Wilson et al.
2004/0044527 A1 3/2004 Thumpudi et al.
2004/0133423 A1 7/2004 Crockett
2004/0165737 A1 8/2004 Monro
2004/0243397 A1 12/2004 Averty et al.
2005/0065780 A1 3/2005 Wiser et al.
2005/0074127 A1 4/2005 Herre et al.
2005/0108007 A1 5/2005 Bessette et al.
2005/0149322 A1 7/2005 Bruhn et al.
2005/0159941 A1 7/2005 Kolesnik et al.
2005/0165611 A1 7/2005 Mehrotra et al.
2005/0195981 A1 9/2005 Faller et al.
2006/0004566 A1 1/2006 Oh et al.
2006/0025991 A1 2/2006 Kim
2006/0074642 A1 4/2006 You
2006/0095269 A1 5/2006 Smith et al.
2006/0106597 A1 5/2006 Stein
2006/0140412 A1 6/2006 Villemoes et al.
2007/0016406 A1 1/2007 Thumpudi et al.
2007/0016415 A1 1/2007 Thumpudi et al.
2007/0016427 A1 1/2007 Thumpudi et al.
2007/0036360 A1 2/2007 Breebaart
2007/0063877 A1 3/2007 Shmunk et al.
2007/0127733 A1 6/2007 Henn et al.
2007/0162277 A1 * 7/2007 Kurniawati et al. ..... 704/200.1
2007/0276661 A1 * 11/2007 Dimkovic et al. ..... 704/229
2008/0052068 A1 2/2008 Aguilar et al.

FOREIGN PATENT DOCUMENTS

DE 4133460 4/1993
EP 0663740 7/1995
EP 854653 7/1998
EP 0910927 4/1999
EP 0931386 7/1999
EP 1396841 3/2004
EP 1783745 5/2007
JP 2003-348598 12/2003
WO WO 02/43054 5/2002

OTHER PUBLICATIONS

Search Report from PCT/US06/27238, dated Aug. 15, 2007.
Search Report from PCT/US06/27420, dated Apr. 26, 2007.
Advanced Television Systems Committee, ATSC Standard: Digital Audio Compression (AC-3), Revision A, 140 pp. (1995).
Arai, et al., "A Fast DCT-SQ Scheme for Images," The Transactions of the IEICE, vol. E 71, No. 11, Nov. 1988, pp. 1095-1097.
Beerends, "Audio Quality Determination Based on Perceptual Measurement Techniques," Applications of Digital Signal Processing to Audio and Acoustics, Chapter 1, Ed. Mark Kahrs, Karlheinz Brandenburg, Kluwer Acad. Publ., pp. 1-38 (1998).
Bjontegaard, "H.26L Test Model Long Term No. 8 (TML-8) Draft 0," Video Coding Experts Group (VCEG), pp. 1-46.
Brandenburg, "ASPEC Coding", AES 10th International Conference, pp. 81-90 (1991).
Caetano et al., "Rate Control Strategy for Embedded Wavelet Video Coders," Electronics Letters, pp. 1815-1817 (Oct. 14, 1999).
Calderbank et al., "Wavelet Transforms that Map Integers to Integers," pp. 1-39 (Aug. 1996).
Cham, "Development of Integer Cosine Transforms by the Principle of Dyadic Symmetry," IEE Proceedings, vol. 136, Pt. 1, No. 4, pp. 276-282 (Aug. 1989).

W. Chen, C. H. Smith, and S. C. Fralick, "A fast computational algorithm for the discrete cosine transform," IEEE Trans. Commun., vol. 25, pp. 1004-1009, Sep. 1977.
J. W. Cooley and J. W. Tukey, "An algorithm for the machine calculation of complex Fourier series," Math. Computation, vol. 19, pp. 297-301, 1965.
R. Cox, "The design of uniformly and nonuniformly spaced pseudoquadrature mirror filters" IEEE Transactions on Acoustics, Speech, and Signal Processing, vol. 34, pp. 1090-1096, Oct. 1986.
De Luca, "AN1090 Application Note: STA013 MPEG 2.5 Layer III Source Decoder," STMicroelectronics, 17 pp. (1999).
de Queiroz et al., "Time-Varying Lapped Transforms and Wavelet Packets," IEEE Transactions on Signal Processing, vol. 41, pp. 3293-3305 (1993).
Dolby Laboratories, "AAC Technology," 4 pp. [Downloaded from the web site aac-audio.com on World Wide Web on Nov. 21, 2001.].
Faller et al., "Binaural Cue Coding Applied to Stereo and Multi-Channel Audio Compression," Audio Engineering Society, Presented at the 112th Convention, May 2002, 9 pages.
Fraunhofer-Gesellschaft, "MPEG Audio Layer-3," 4 pp. [Downloaded from the World Wide Web on Oct. 24, 2001.].
Fraunhofer-Gesellschaft, "MPEG-2 AAC," 3 pp. [Downloaded from the World Wide Web on Oct. 24, 2001.].
Gibson et al., Digital Compression for Multimedia, Title Page, Contents, "Chapter 7: Frequency Domain Coding," Morgan Kaufman Publishers, Inc., pp. iii, v-xi, and 227-262 (1998).
Mark Hasegawa-Johnson and Abeer Alwan, "Speech coding: fundamentals and applications," Handbook of Telecommunications, John Wiley and Sons, Inc., pp. 1-33 (2003). [available at http://citeseer.ist.psu.edu/617093.html].
Herley et al., "Tilings of the Time-Frequency Plane: Construction of Arbitrary Orthogonal Bases and Fast Tiling Algorithms," IEEE Transactions on Signal Processing, vol. 41, No. 12, pp. 3341-3359 (1993).
Herre et al., "MP3 Surround: Efficient and Compatible Coding of Multi-Channel Audio," 116th Audio Engineering Society Convention, 2004, 14 pages.
International Search Report and Written Opinion for PCT/US06/27420, dated Apr. 26, 2007, 8 pages.
"ISO/IEC 11172-3, Information Technology—Coding of Moving Pictures and Associated Audio for Digital Storage Media at Up to About 1.5 Mbit/s—Part 3: Audio," 154 pp. (1993).
"ISO/IEC 13818-7, Information Technology—Generic Coding of Moving Pictures and Associated Audio Information—Part 7: Advanced Audio Coding (AAC)," 174 pp. (1997).
"ISO/IEC 13818-7, Information Technology—Generic Coding of Moving Pictures and Associated Audio Information—Part 7: Advanced Audio Coding (AAC), Technical Corrigendum 1" 22 pp. (1998).
ITU, Recommendation ITU-R BS 1115, Low Bit-Rate Audio Coding, 9 pp. (1994).
ITU, Recommendation ITU-R BS 1387, Method for Objective Measurements of Perceived Audio Quality, 89 pp. (1998).
Jesteadt et al., "Forward Masking as a Function of Frequency, Masker Level, and Signal Delay," Journal of Acoustical Society of America, 71:950-962 (1982).
A.M. Kondoz, Digital Speech: Coding for Low Bit Rate Communications Systems, "Chapter 3.3: Linear Predictive Modeling of Speech Signals" and "Chapter 4: LPC Parameter Quantisation Using LSFs," John Wiley & Sons, pp. 42-53 and 79-97 (1994).
Lau et al., "A Common Transform Engine for MPEG and AC3 Audio Decoder," IEEE Trans. Consumer Electron., vol. 43, Issue 3, Jun. 1997, pp. 559-566.
Li et al., "On Implementing Transforms from Integers to Integers," Department of Electrical Engineering, Princeton University, pp. 881-885, Jun. 1998.
Liang et al., "A 16-bit Architecture for H.26L, Treating DCT Transforms and Quantization," Thirteenth Meeting: Austin, Texas, USA, pp. 1-17 (Apr. 2001).
Liang et al., "Fast Multiplierless Approximation of the DCT with the Lifting Scheme," Proc. SPIE Apps. of Digital Image Procesing XXIII, 12 pages (Aug. 2000).
C. Loeffler et al., "Practical fast 1-D DCT algorithms with 11 multiplications," Proc. IEEE ICASSP, vol. 2, pp. 988-991, Feb. 1989.
Lufti, "Additivity of Simultaneous Masking," Journal of Acoustic Society of America, 73:262-267 (1983).
Malvar, "Biorthogonal and Nonuniform Lapped Transforms for Transform Coding with Reduced Blocking and Ringing Artifacts," appeared in IEEE Transactions on Signal Processing, Special Issue on Multirate Systems, Filter Banks, Wavelets, and Applications, vol. 46, 29 pp. (1998).
H. S. Malvar, "Enhancing the performance of subband audio coders for speech signals", Proc. 1998 IEEE International Symposium on Circuits and Systems, vol. 5, pp. 98-101, Jun. 1998.
H. Malvar, "Fast computation of the discrete cosine transform and the discrete Hartley transform," IEEE Trans. Acoust., Speech, Signal Processing, vol. ASSP-35, pp. 1484-1485, Oct. 1987.
H.S. Malvar, "Lapped Transforms for Efficient Transform/Subband Coding," IEEE Transactions on Acoustics, Speech and Signal Processing, vol. 38, No. 6, pp. 969-978 (1990).
H.S. Malvar, Signal Processing with Lapped Transforms, Artech House, Norwood, MA, pp. iv, vii-xi, 175-218, 353-357 (1992).
Najafzadeh-Azghandi, Hossein and Kabal, Peter, "Perceptual coding of narrowband audio signals at 8 Kbit/s" (1997), available at http://citeseer.ist.psu.edu/najafzadeh-azghandi97perceptual.html.
O. A. Niamut and R. Heusdens, "Subband merging in cosine-modulated filter banks", IEEE Signal Processing Letters, vol. 10, pp. 111-114, Apr. 2003.
OPTICOM GmbH, "Objective Perceptual Measurement," 14 pp. [Downloaded from the World Wide Web on Oct. 24, 2001.].
Painter et al., "A Review of Algorithms for Perceptual Coding of Digital Audio Signals," Digital Signal Processing Proceedings, 1997, 30 pp.
Painter, T. and Spanias, A., "Perceptual Coding of Digital Audio," Proceedings of the IEEE, vol. 88, Issue 4, pp. 451-515, Apr. 2000, available at http://www.eas.asu.edu/~spanias/papers/paper-audio-tedspanias-00.pdf.
Phamdo, "Speech Compression," 13 pages [Downloaded from the World Wide Web on Nov. 25, 2001.].
Ravier et al., "Using Malvar Wavelets for Transient Detection," Jun. 1996, IEEE, pp. 229-232.
Ribas Corbera et al., "Rate Control in DCT Video Coding for Low-Delay Communications," IEEE Transactions on Circuits and Systems for Video Technology, vol. 9, No. 1, pp. 172-185 (Feb. 1999).
Rijkse, "H.263: Video Coding for Low-Bit-Rate Communication," IEEE Comm., vol. 34, No. 12, Dec. 1996, pp. 42-45.
Rubino et al., "Improved Chen-Smith Image Coder," Electrical Engineering Department, Iniversity of Texas at Arlington, pp. 267-270, 1993.
Scheirer, "The MPEG-4 Structured Audio standard," Proc 1998 IEEE ICASSP, 1998, pp. 3801-3804.
M. Schroeder, B. Atal, "Code-excited linear prediction (CELP): High-quality speech at very low bit rates," Proc. IEEE Int. Conf ASSP, pp. 937-940, 1985.
Schulz, D., "Improving audio codecs by noise substitution," Journal of the AES, vol. 44, No. 7/8, pp. 593-598, Jul./Aug. 1996.
Seymour Shlien, "The Modulated Lapped Transform, Its Time-Varying Forms, and Its Application to Audio Coding Standards," IEEE Transactions on Speech and Audio Processing, vol. 5, No. 4, pp. 359-366 (Jul. 1997).
Solari, Digital Video and Audio Compression, Title Page, Contents, "Chapter 8: Sound and Audio," McGraw-Hill, Inc., pp. iii, v-vi, and 187-211 (1997).
Th. Sporer, Kh. Brandenburg, B. Edler, "The Use of Multirate Filter Banks for Coding of High Quality Digital Audio," 6th European Signal Processing Conference (EUSIPCO), Amsterdam, vol. 1, pp. 211-214, Jun. 1992.
Srinivasan et al., "High-Quality Audio Compression Using an Adaptive Wavelet Packet Decomposition and Psychoacoustic Modeling," IEEE Transactions on Signal Processing, vol. 46, No. 4, pp. 1085-1093 (Apr. 1998).
Terhardt, "Calculating Virtual Pitch," Hearing Research, 1:155-182 (1979).
Todd et. al., "AC-3: Flexible Perceptual Coding for Audio Transmission and Storage,"96th Conv. Of AES, Feb. 1994, 16 pp.

Tucker, "Low bit-rate frequency extension coding," IEEE Colloquium on Audio and Music Technology, Nov. 1998, 5 pages.
Wragg et al., "An Optimised Software Solution for an ARM PoweredTM MP3 Decoder," 9 pp. [Downloaded from the World Wide Web on Oct. 27, 2001.].
Yang et al., "Progressive Syntax-Rich Coding of Multichannel Audio Sources," EURASIP Journal on Applied Signal Processing, 2003, pp. 980-992.
Zwicker et al., Das Ohr als Nachrichtenempfänger, Title Page, Table of Contents, "I: Schallschwingungen," Index, Hirzel-Verlag, Stuttgart, pp. III, IX-XI, 1-26, and 231-232 (1967).
Zwicker, Psychoakustik, Title Page, Table of Contents, "Teil I: Einfuhrung," Index, Springer-Verlag, Berlin Heidelberg, New York, pp. II, IX-XI, 1-30, and 157-162 (1982).
Korhonen et al., "Schemes for Error Resilient Streaming of Perceptually Coded Audio," *Proceedings of the 2003 IEEE International Conference on Acoustics, Speech & Signal Processing*, 2003, pp. 165-168.
Noll, "Digital Audio Coding for Visual Communications," *Proceedings of the IEEE*, vol. 83, No. 6, Jun. 1995, pp. 925-943.

* cited by examiner

FLEXIBLE FREQUENCY AND TIME PARTITIONING IN PERCEPTUAL TRANSFORM CODING OF AUDIO

BACKGROUND

Perceptual Transform Coding

The coding of audio utilizes coding techniques that exploit various perceptual models of human hearing. For example, many weaker tones near strong ones are masked so they do not need to be coded. In traditional perceptual audio coding, this is exploited as adaptive quantization of different frequency data. Perceptually important frequency data are allocated more bits and thus finer quantization and vice versa.

For example, transform coding is conventionally known as an efficient scheme for the compression of audio signals. In transform coding, a block of the input audio samples is transformed (e.g., via the Modified Discrete Cosine Transform or MDCT, which is the most widely used), processed, and quantized. The quantization of the transformed coefficients is performed based on the perceptual importance (e.g. masking effects and frequency sensitivity of human hearing), such as via a scalar quantizer.

When a scalar quantizer is used, the importance is mapped to relative weighting, and the quantizer resolution (step size) for each coefficient is derived from its weight and the global resolution. The global resolution can be determined from target quality, bit rate, etc. For a given step size, each coefficient is quantized into a level which is zero or non-zero integer value.

At lower bitrates, there are typically a lot more zero level coefficients than non-zero level coefficients. They can be coded with great efficiency using run-length coding. In run-length coding, all zero-level coefficients typically are represented by a value pair consisting of a zero run (i.e., length of a run of consecutive zero-level coefficients), and level of the non-zero coefficient following the zero run. The resulting sequence is $R_0$, $L_0$, $R_1$, $L_1$. . . , where R is zero run and L is non-zero level.

By exploiting the redundancies between R and L, it is possible to further improve the coding performance. Run-level Huffman coding is a reasonable approach to achieve it, in which R and L are combined into a 2-D array (R,L) and Huffman-coded.

When transform coding at low bit rates, a large number of the transform coefficients tend to be quantized to zero to achieve a high compression ratio. This could result in there being large missing portions of the spectral data in the compressed bitstream. After decoding and reconstruction of the audio, these missing spectral portions can produce an unnatural and annoying distortion in the audio. Moreover, the distortion in the audio worsens as the missing portions of spectral data become larger. Further, a lack of high frequencies due to quantization makes the decoded audio sound muffled and unpleasant.

Wide-Sense Perceptual Similarity

Perceptual coding also can be taken to a broader sense. For example, some parts of the spectrum can be coded with appropriately shaped noise. When taking this approach, the coded signal may not aim to render an exact or near exact version of the original. Rather the goal is to make it sound similar and pleasant when compared with the original. For example, a wide-sense perceptual similarity technique may code a portion of the spectrum as a scaled version of a code-vector, where the code vector may be chosen from either a fixed predetermined codebook (e.g., a noise codebook), or a codebook taken from a baseband portion of the spectrum (e.g., a baseband codebook).

All these perceptual effects can be used to reduce the bit-rate needed for coding of audio signals. This is because some frequency components do not need to be accurately represented as present in the original signal, but can be either not coded or replaced with something that gives the same perceptual effect as in the original.

In low bit rate coding, a recent trend is to exploit this wide-sense perceptual similarity and use a vector quantization (e.g., as a gain and shape code-vector) to represent the high frequency components with very few bits, e.g., 3 kbps. This can alleviate the distortion and unpleasant muffled effect from missing high frequencies. The transform coefficients of the "spectral holes" also are encoded using the vector quantization scheme. It has been shown that this approach enhances the audio quality with a small increase of bit rate.

Nevertheless, due to the bitrate limitation, the quantization is very coarse. While this is efficient and sufficient for the vast majority of the signals, it still causes an unacceptable distortion for high frequency components that are very "tonal." A typical example can be the very high pitched sound from a string instrument. The vector quantizer may distort the tones into a coarse sounding noise.

Another problem is that for quantization at lower bit rates, it is often the case that many large spectral holes and missing high frequencies appear at the same time. The existing techniques based on wide-sense perceptual similarity split the spectral data into a number of sub-vectors (referred to herein as "bands"), with each vector having its own shape data. The existing techniques have to allocate significant number of bands for the spectral holes, such that enough bands may not be left to code the missing high frequency data when spectral holes and missing high frequencies occur simultaneously.

A further problem is that this vector quantization may introduce distortion that is much more noticeable when it is applied to lower frequencies of the spectrum. The audio typically consists of stationary (typically tonal) components as well as "transients." The tonal components desirably are encoded using a larger transform window size for better frequency resolution and compression efficiency, while a smaller transform window size better preserves the time resolution of the transients. A typical approach therefore has been to apply a window switching technique. However, the vector quantization technique and window switching technique do not necessarily work well together.

SUMMARY

The following Detailed Description concerns various audio encoding/decoding techniques and tools that provide a way to fill spectral "holes" and missing high frequencies that may result from quantization at low bit rates, as well as flexibly combine coding at different transform window sizes along with vector quantization.

The described techniques include various ways of partitioning spectral holes and missing high frequencies into a band structure for coding using vector quantization (wide-sense perceptual similarity). In one described partitioning procedure applied to spectral holes (herein also referred to as the "hole-filling procedure"), a band structure is determined based on two threshold parameters: a minimum hole size threshold and a maximum band size threshold. In this procedure, the spectral coefficients produced by the block transform and quantization processes are searched for spectral holes whose width exceeds the minimum hole size threshold.

Such holes are partitioned evenly into the fewest number of bands whose size does not exceed the maximum band size threshold. Thus, the number of bands required to fill the spectral holes can be controlled by these two threshold parameters. The vector quantization is then used to code shape vector(s) for the partitioned bands that are similar to the spectral coefficients that occupied the hole position prior to quantization (effectively, "filling the hole" in the spectrum).

In a further described partitioning procedure applied to a missing high frequency region (herein also referred to as the "frequency extension procedure"), a band structure for vector quantization of the high-frequency region is determined by dividing the region into a desired number of bands. The bands can be structured such that the ratio of band size of successive bands is binary increasing, linearly increasing, or an arbitrary configuration of band sizes.

In a further partitioning procedure applied to a combination of spectral holes and missing high frequency region (herein also referred to as the "overlay procedure"), an approach similar to the frequency extension procedure is applied over the whole of both the spectral holes and high frequency region.

In another partitioning procedure also applied to a combination of spectral holes and missing high frequency region, a band structure for the spectral holes is first configured as per the hole-filling procedure by allocating bands until all spectral holes are filled or the number of bands allocated to filling spectral holes reaches a predetermined maximum number of hole-filling bands. If all spectral holes are covered, a band structure for the missing high frequency region is determined as per the frequency extension procedure. Otherwise, the overlay procedure is applied to the whole of the unfilled spectral holes and missing high frequency region. The number of bands for the frequency extension procedure or the overlay procedure is equal to a desired number of bands less the number of bands allocated in the hole filling procedure. With this approach, more bands can be allocated to the missing high frequency region. Due to masking effects (the spectral holes are usually low energy regions between high energy regions), the spectral holes do not require partitioning into as fine of a band structure. The approach then reserves more bands for allocating to the more perceptually sensitive missing frequency region than to the spectral holes.

The described techniques also include various ways to effectively combine vector quantization coding together with adaptively varying transform block sizes for tonal and transient sounds. With this approach, a traditional quantization coding using a first window size (i.e., transform block size) is applied to a portion of the spectrum, while vector quantization coding is applied to another portion of the spectrum. The vector quantization coding can use the same or a different (e.g., smaller) window (transform block) size to better preserve the time resolution of transients. In another variation, vector quantization coding using two different window sizes can be applied to a part of the spectrum. At the decoder, the separately coded parts of the spectrum are combined (e.g., summed) to produce the reconstructed audio signal.

This Summary is provided to introduce a selection of concepts in a simplified form that is further described below in the Detailed Description. This summary is not intended to identify key features or essential features of the claimed subject matter, nor is it intended to be used as an aid in determining the scope of the claimed subject matter. Additional features and advantages of the invention will be made apparent from the following detailed description of embodiments that proceeds with reference to the accompanying drawings.

DETAILED DESCRIPTION

Various techniques and tools for representing, coding, and decoding audio information are described. These techniques and tools facilitate the creation, distribution, and playback of high quality audio content, even at very low bitrates.

The various techniques and tools described herein may be used independently. Some of the techniques and tools may be used in combination (e.g., in different phases of a combined encoding and/or decoding process).

Various techniques are described below with reference to flowcharts of processing acts. The various processing acts shown in the flowcharts may be consolidated into fewer acts or separated into more acts. For the sake of simplicity, the relation of acts shown in a particular flowchart to acts described elsewhere is often not shown. In many cases, the acts in a flowchart can be reordered.

Much of the detailed description addresses representing, coding, and decoding audio information. Many of the techniques and tools described herein for representing, coding, and decoding audio information can also be applied to video information, still image information, or other media information sent in single or multiple channels.

I. Computing Environment

Figure 1:
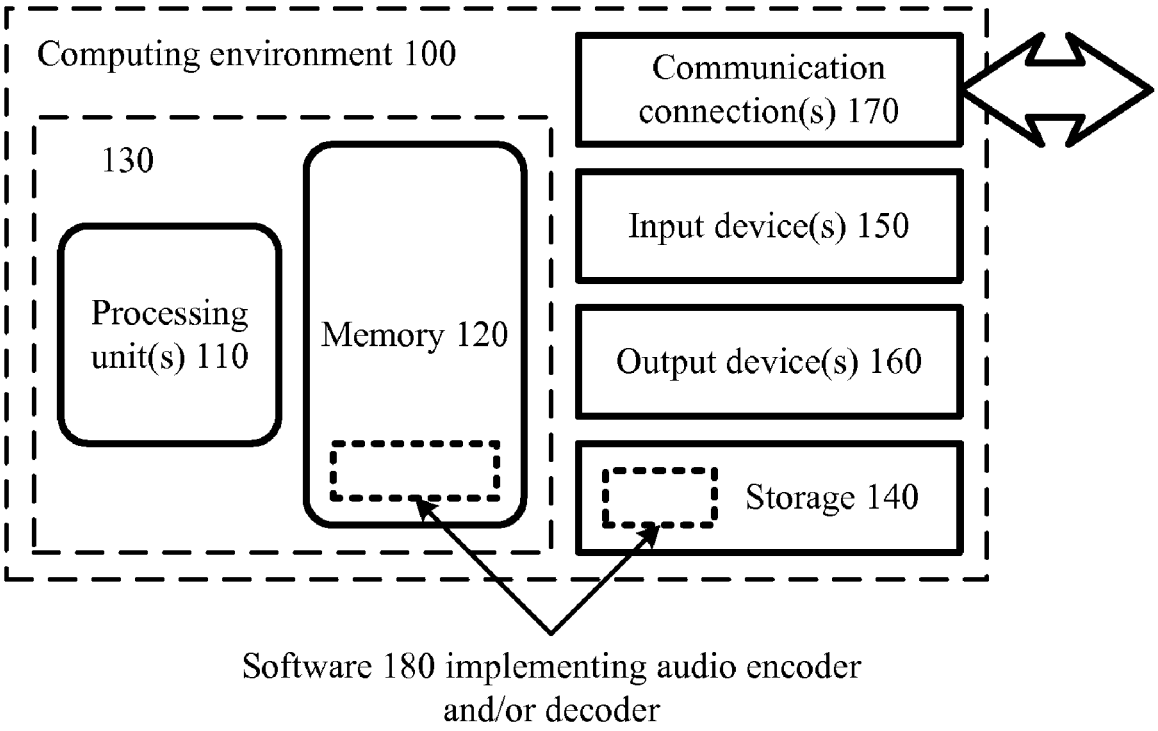
FIG. 1 is a block diagram of a generalized operating environment in conjunction with which various described embodiments may be implemented.

FIG. 1 illustrates a generalized example of a suitable computing environment 100 in which described embodiments may be implemented. The computing environment 100 is not intended to suggest any limitation as to scope of use or functionality, as described embodiments may be implemented in diverse general-purpose or special-purpose computing environments.

With reference to FIG. 1, the computing environment 100 includes at least one processing unit 110 and memory 120. In FIG. 1, this most basic configuration 130 is included within a dashed line. The processing unit 110 executes computer-executable instructions and may be a real or a virtual processor. In a multi-processing system, multiple processing units execute computer-executable instructions to increase processing power. The processing unit also can comprise a central processing unit and co-processors, and/or dedicated or special purpose processing units (e.g., an audio processor). The memory 120 may be volatile memory (e.g., registers, cache, RAM), non-volatile memory (e.g., ROM, EEPROM, flash memory), or some combination of the two. The memory 120 stores software 180 implementing one or more audio processing techniques and/or systems according to one or more of the described embodiments.

A computing environment may have additional features. For example, the computing environment 100 includes storage 140, one or more input devices 150, one or more output devices 160, and one or more communication connections 170. An interconnection mechanism (not shown) such as a bus, controller, or network interconnects the components of the computing environment 100. Typically, operating system software (not shown) provides an operating environment for software executing in the computing environment 100 and coordinates activities of the components of the computing environment 100.

The storage 140 may be removable or non-removable, and includes magnetic disks, magnetic tapes or cassettes, CDs, DVDs, or any other medium which can be used to store information and which can be accessed within the computing environment 100. The storage 140 stores instructions for the software 180.

The input device(s) 150 may be a touch input device such as a keyboard, mouse, pen, touchscreen or trackball, a voice input device, a scanning device, or another device that provides input to the computing environment 100. For audio or video, the input device(s) 150 may be a microphone, sound card, video card, TV tuner card, or similar device that accepts audio or video input in analog or digital form, or a CD or DVD that reads audio or video samples into the computing environment. The output device(s) 160 may be a display, printer, speaker, CD/DVD-writer, network adapter, or another device that provides output from the computing environment 100.

The communication connection(s) 170 enable communication over a communication medium to one or more other computing entities. The communication medium conveys information such as computer-executable instructions, audio or video information, or other data in a data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

Embodiments can be described in the general context of computer-readable media. Computer-readable media are any available media that can be accessed within a computing environment. By way of example, and not limitation, with the computing environment 100, computer-readable media include memory 120, storage 140, communication media, and combinations of any of the above.

Embodiments can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular data types. The functionality of the program modules may be combined or split between program modules as desired in various embodiments. Computer-executable instructions for program modules may be executed within a local or distributed computing environment.

For the sake of presentation, the detailed description uses terms like "determine," "receive," and "perform" to describe computer operations in a computing environment. These terms are high-level abstractions for operations performed by a computer, and should not be confused with acts performed by a human being. The actual computer operations corresponding to these terms vary depending on implementation.

II. Example Encoders and Decoders

Figure 2:
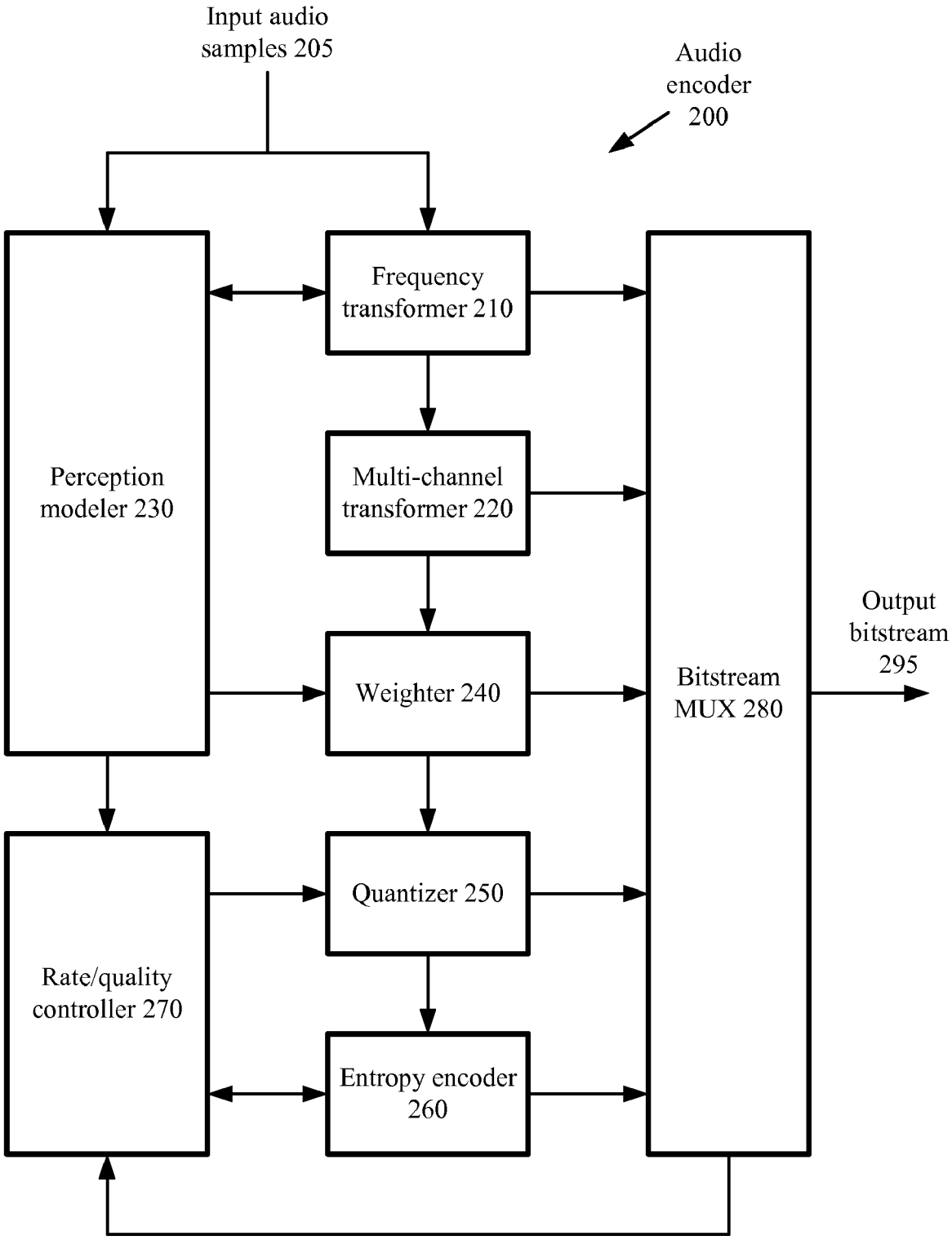
FIGS. 2, 3, 4, and 5 are block diagrams of generalized encoders and/or decoders in conjunction with which various described embodiments may be implemented.
Figure 3:
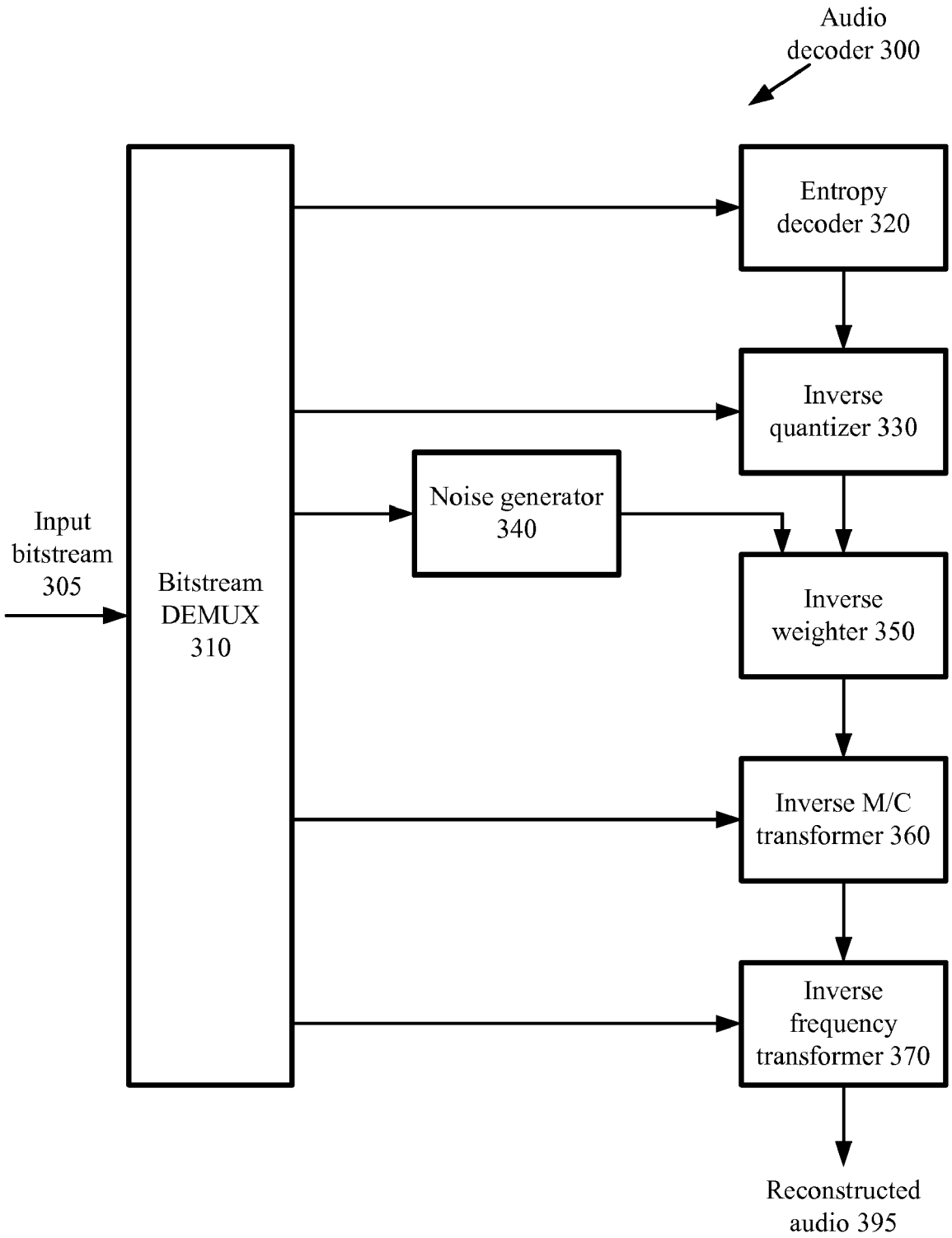

FIG. 2 shows a first audio encoder 200 in which one or more described embodiments may be implemented. The encoder 200 is a transform-based, perceptual audio encoder 200. FIG. 3 shows a corresponding audio decoder 300.

Figure 4:
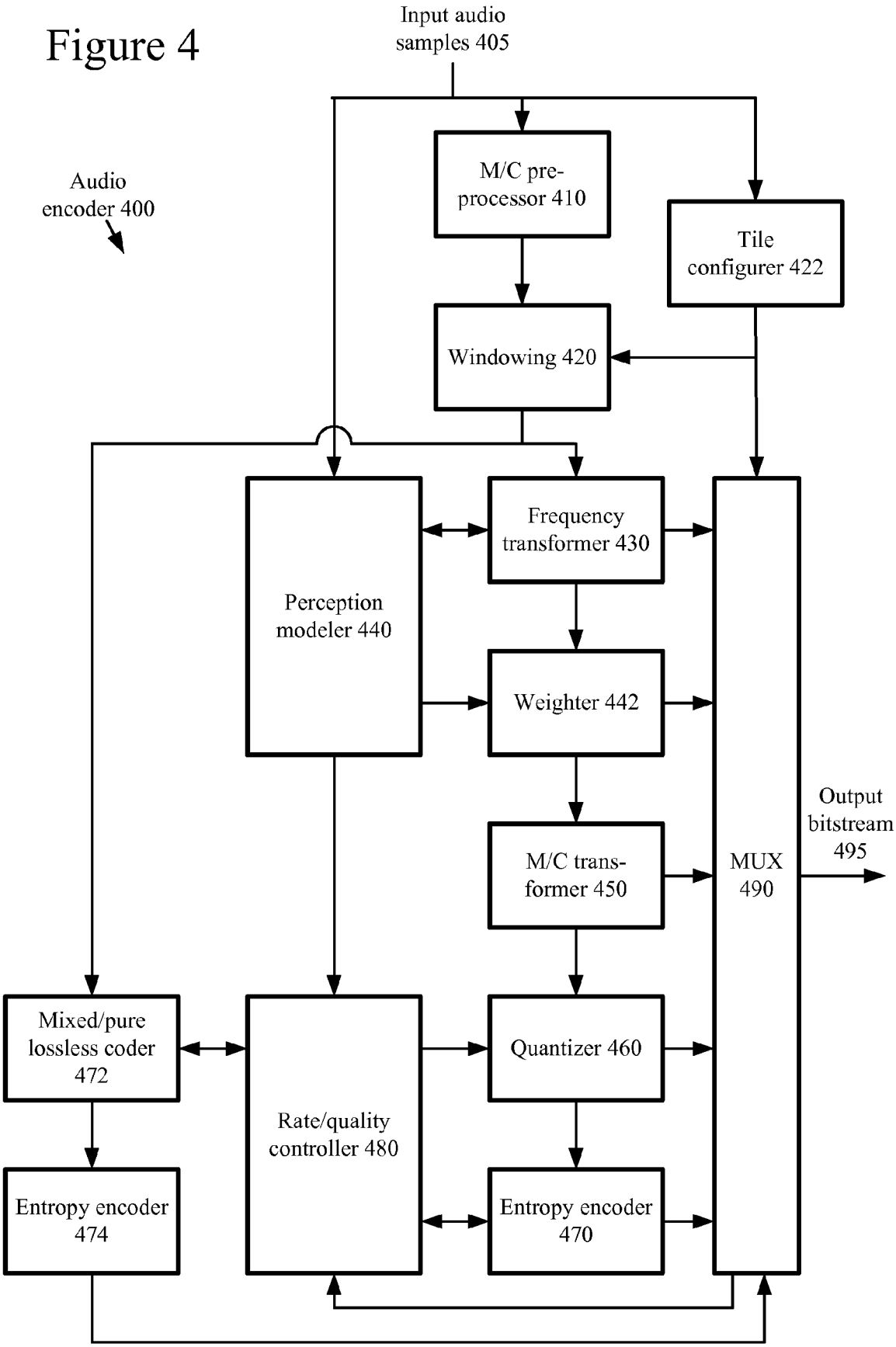
Figure 5:
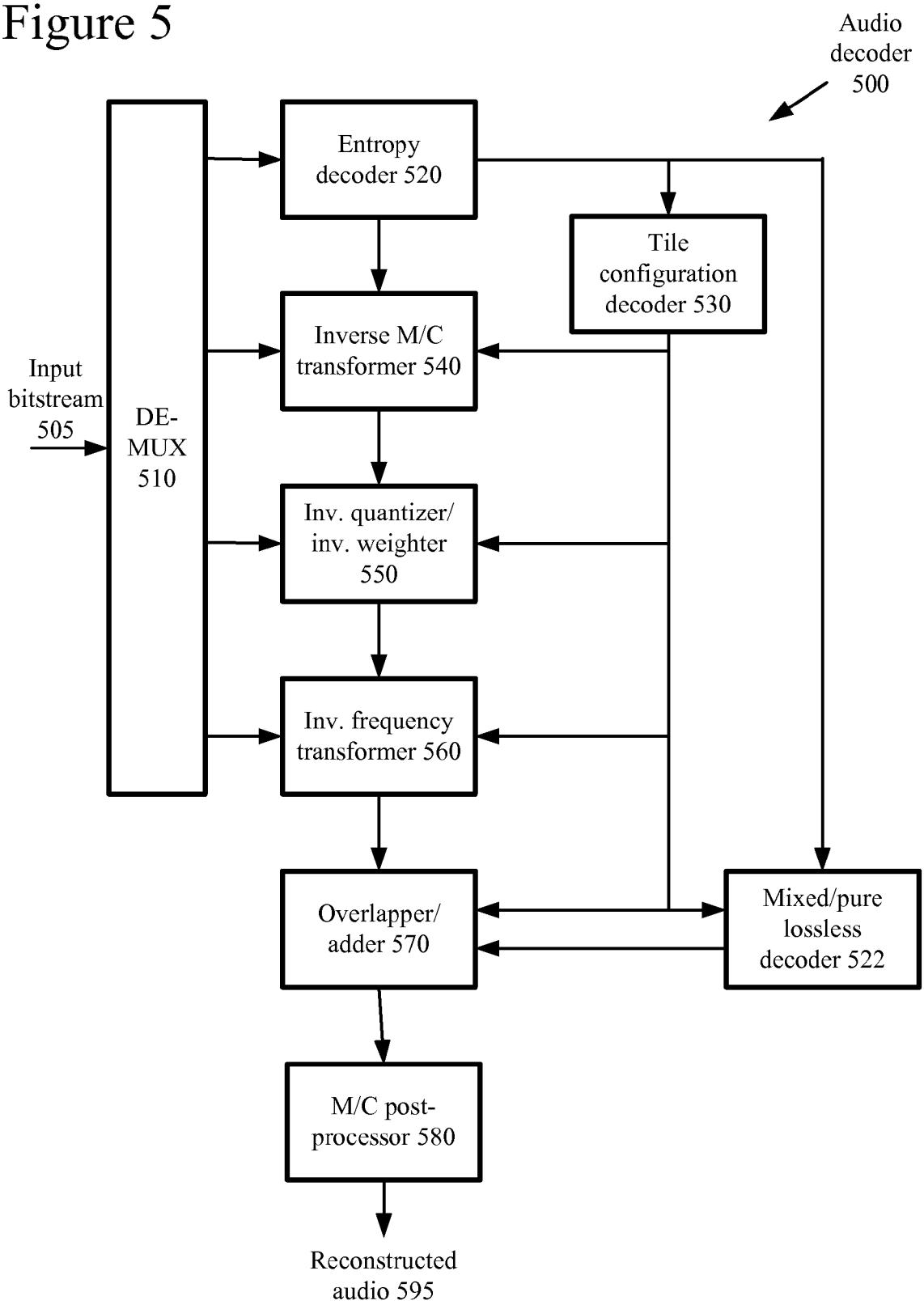

FIG. 4 shows a second audio encoder 400 in which one or more described embodiments may be implemented. The encoder 400 is again a transform-based, perceptual audio encoder, but the encoder 400 includes additional modules, such as modules for processing multi-channel audio. FIG. 5 shows a corresponding audio decoder 500.

Though the systems shown in FIGS. 2 through 5 are generalized, each has characteristics found in real world systems. In any case, the relationships shown between modules within the encoders and decoders indicate flows of information in the encoders and decoders; other relationships are not shown for the sake of simplicity. Depending on implementation and the type of compression desired, modules of an encoder or decoder can be added, omitted, split into multiple modules, combined with other modules, and/or replaced with like modules. In alternative embodiments, encoders or decoders with different modules and/or other configurations process audio data or some other type of data according to one or more described embodiments.

A. First Audio Encoder

The encoder 200 receives a time series of input audio samples 205 at some sampling depth and rate. The input audio samples 205 are for multi-channel audio (e.g., stereo) or mono audio. The encoder 200 compresses the audio samples 205 and multiplexes information produced by the various modules of the encoder 200 to output a bitstream 295 in a compression format such as a WMA format, a container format such as Advanced Streaming Format ("ASF"), or other compression or container format.

The frequency transformer 210 receives the audio samples 205 and converts them into data in the frequency (or spectral) domain. For example, the frequency transformer 210 splits the audio samples 205 of frames into sub-frame blocks, which can have variable size to allow variable temporal resolution. Blocks can overlap to reduce perceptible discontinuities between blocks that could otherwise be introduced by later quantization. The frequency transformer 210 applies to blocks a time-varying Modulated Lapped Transform ("MLT"), modulated DCT ("MDCT"), some other variety of MLT or DCT, or some other type of modulated or non-modulated, overlapped or non-overlapped frequency transform, or uses sub-band or wavelet coding. The frequency transformer 210 outputs blocks of spectral coefficient data and outputs side information such as block sizes to the multiplexer ("MUX") 280.

For multi-channel audio data, the multi-channel transformer 220 can convert the multiple original, independently coded channels into jointly coded channels. Or, the multi-channel transformer 220 can pass the left and right channels through as independently coded channels. The multi-channel transformer 220 produces side information to the MUX 280 indicating the channel mode used. The encoder 200 can apply multi-channel rematrixing to a block of audio data after a multi-channel transform.

The perception modeler 230 models properties of the human auditory system to improve the perceived quality of the reconstructed audio signal for a given bitrate. The perception modeler 230 uses any of various auditory models and passes excitation pattern information or other information to the weighter 240. For example, an auditory model typically considers the range of human hearing and critical bands (e.g., Bark bands). Aside from range and critical bands, interactions between audio signals can dramatically affect perception. In addition, an auditory model can consider a variety of other factors relating to physical or neural aspects of human perception of sound.

The perception modeler 230 outputs information that the weighter 240 uses to shape noise in the audio data to reduce the audibility of the noise. For example, using any of various techniques, the weighter 240 generates weighting factors for quantization matrices (sometimes called masks) based upon the received information. The weighting factors for a quantization matrix include a weight for each of multiple quantization bands in the matrix, where the quantization bands are frequency ranges of frequency coefficients. Thus, the weighting factors indicate proportions at which noise/quantization error is spread across the quantization bands, thereby controlling spectral/temporal distribution of the noise/quantization error, with the goal of minimizing the audibility of the noise by putting more noise in bands where it is less audible, and vice versa.

The weighter 240 then applies the weighting factors to the data received from the multi-channel transformer 220.

The quantizer 250 quantizes the output of the weighter 240, producing quantized coefficient data to the entropy encoder 260 and side information including quantization step size to the MUX 280. In FIG. 2, the quantizer 250 is an adaptive, uniform, scalar quantizer. The quantizer 250 applies the same quantization step size to each spectral coefficient, but the quantization step size itself can change from one iteration of a quantization loop to the next to affect the bitrate of the entropy encoder 260 output. Other kinds of quantization are non-uniform, vector quantization, and/or non-adaptive quantization.

The entropy encoder 260 losslessly compresses quantized coefficient data received from the quantizer 250, for example, performing run-level coding and vector variable length coding. The entropy encoder 260 can compute the number of bits spent encoding audio information and pass this information to the rate/quality controller 270.

The controller 270 works with the quantizer 250 to regulate the bitrate and/or quality of the output of the encoder 200. The controller 270 outputs the quantization step size to the quantizer 250 with the goal of satisfying bitrate and quality constraints.

In addition, the encoder 200 can apply noise substitution and/or band truncation to a block of audio data.

The MUX 280 multiplexes the side information received from the other modules of the audio encoder 200 along with the entropy encoded data received from the entropy encoder 260. The MUX 280 can include a virtual buffer that stores the bitstream 295 to be output by the encoder 200.

B. First Audio Decoder

The decoder 300 receives a bitstream 305 of compressed audio information including entropy encoded data as well as side information, from which the decoder 300 reconstructs audio samples 395.

The demultiplexer ("DEMUX") 310 parses information in the bitstream 305 and sends information to the modules of the decoder 300. The DEMUX 310 includes one or more buffers to compensate for short-term variations in bitrate due to fluctuations in complexity of the audio, network jitter, and/or other factors.

The entropy decoder 320 losslessly decompresses entropy codes received from the DEMUX 310, producing quantized spectral coefficient data. The entropy decoder 320 typically applies the inverse of the entropy encoding techniques used in the encoder.

The inverse quantizer 330 receives a quantization step size from the DEMUX 310 and receives quantized spectral coefficient data from the entropy decoder 320. The inverse quantizer 330 applies the quantization step size to the quantized frequency coefficient data to partially reconstruct the frequency coefficient data, or otherwise performs inverse quantization.

From the DEMUX 310, the noise generator 340 receives information indicating which bands in a block of data are noise substituted as well as any parameters for the form of the noise. The noise generator 340 generates the patterns for the indicated bands, and passes the information to the inverse weighter 350.

The inverse weighter 350 receives the weighting factors from the DEMUX 310, patterns for any noise-substituted bands from the noise generator 340, and the partially reconstructed frequency coefficient data from the inverse quantizer 330. As necessary, the inverse weighter 350 decompresses weighting factors. The inverse weighter 350 applies the weighting factors to the partially reconstructed frequency coefficient data for bands that have not been noise substituted. The inverse weighter 350 then adds in the noise patterns received from the noise generator 340 for the noise-substituted bands.

The inverse multi-channel transformer 360 receives the reconstructed spectral coefficient data from the inverse weighter 350 and channel mode information from the DEMUX 310. If multi-channel audio is in independently coded channels, the inverse multi-channel transformer 360 passes the channels through. If multi-channel data is in jointly coded channels, the inverse multi-channel transformer 360 converts the data into independently coded channels.

The inverse frequency transformer 370 receives the spectral coefficient data output by the multi-channel transformer 360 as well as side information such as block sizes from the DEMUX 310. The inverse frequency transformer 370 applies the inverse of the frequency transform used in the encoder and outputs blocks of reconstructed audio samples 395.

C. Second Audio Encoder

With reference to FIG. 4, the encoder 400 receives a time series of input audio samples 405 at some sampling depth and rate. The input audio samples 405 are for multi-channel audio (e.g., stereo, surround) or mono audio. The encoder 400 compresses the audio samples 405 and multiplexes information produced by the various modules of the encoder 400 to output a bitstream 495 in a compression format such as a WMA Pro format, a container format such as ASF, or other compression or container format.

The encoder 400 selects between multiple encoding modes for the audio samples 405. In FIG. 4, the encoder 400 switches between a mixed/pure lossless coding mode and a lossy coding mode. The lossless coding mode includes the mixed/pure lossless coder 472 and is typically used for high quality (and high bitrate) compression. The lossy coding mode includes components such as the weighter 442 and quantizer 460 and is typically used for adjustable quality (and controlled bitrate) compression. The selection decision depends upon user input or other criteria.

For lossy coding of multi-channel audio data, the multi-channel pre-processor 410 optionally re-matrixes the time-domain audio samples 405. For example, the multi-channel pre-processor 410 selectively re-matrixes the audio samples 405 to drop one or more coded channels or increase inter-channel correlation in the encoder 400, yet allow reconstruction (in some form) in the decoder 500. The multi-channel pre-processor 410 may send side information such as instructions for multi-channel post-processing to the MUX 490.

The windowing module 420 partitions a frame of audio input samples 405 into sub-frame blocks (windows). The windows may have time-varying size and window shaping functions. When the encoder 400 uses lossy coding, variable-size windows allow variable temporal resolution. The windowing module 420 outputs blocks of partitioned data and outputs side information such as block sizes to the MUX 490.

In FIG. 4, the tile configurer 422 partitions frames of multi-channel audio on a per-channel basis. The tile configurer 422 independently partitions each channel in the frame, if quality/bitrate allows. This allows, for example, the tile configurer 422 to isolate transients that appear in a particular channel with smaller windows, but use larger windows for frequency resolution or compression efficiency in other channels. This can improve compression efficiency by isolating transients on a per channel basis, but additional information specifying the partitions in individual channels is needed in many cases. Windows of the same size that are co-located in time may qualify for further redundancy reduction through multi-channel transformation. Thus, the tile configurer 422 groups windows of the same size that are co-located in time as a tile.

The frequency transformer 430 receives audio samples and converts them into data in the frequency domain, applying a transform such as described above for the frequency transformer 210 of FIG. 2. The frequency transformer 430 outputs blocks of spectral coefficient data to the weighter 442 and outputs side information such as block sizes to the MUX 490. The frequency transformer 430 outputs both the frequency coefficients and the side information to the perception modeler 440.

The perception modeler 440 models properties of the human auditory system, processing audio data according to an auditory model, generally as described above with reference to the perception modeler 230 of FIG. 2.

The weighter 442 generates weighting factors for quantization matrices based upon the information received from the perception modeler 440, generally as described above with reference to the weighter 240 of FIG. 2. The weighter 442 applies the weighting factors to the data received from the frequency transformer 430. The weighter 442 outputs side information such as the quantization matrices and channel weight factors to the MUX 490. The quantization matrices can be compressed.

For multi-channel audio data, the multi-channel transformer 450 may apply a multi-channel transform to take advantage of inter-channel correlation. For example, the multi-channel transformer 450 selectively and flexibly applies the multi-channel transform to some but not all of the channels and/or quantization bands in the tile. The multi-channel transformer 450 selectively uses pre-defined matrices or custom matrices, and applies efficient compression to the custom matrices. The multi-channel transformer 450 produces side information to the MUX 490 indicating, for example, the multi-channel transforms used and multi-channel transformed parts of tiles.

The quantizer 460 quantizes the output of the multi-channel transformer 450, producing quantized coefficient data to the entropy encoder 470 and side information including quantization step sizes to the MUX 490. In FIG. 4, the quantizer 460 is an adaptive, uniform, scalar quantizer that computes a quantization factor per tile, but the quantizer 460 may instead perform some other kind of quantization.

The entropy encoder 470 losslessly compresses quantized coefficient data received from the quantizer 460, generally as described above with reference to the entropy encoder 260 of FIG. 2.

The controller 480 works with the quantizer 460 to regulate the bitrate and/or quality of the output of the encoder 400. The controller 480 outputs the quantization factors to the quantizer 460 with the goal of satisfying quality and/or bitrate constraints.

The mixed/pure lossless encoder 472 and associated entropy encoder 474 compress audio data for the mixed/pure lossless coding mode. The encoder 400 uses the mixed/pure lossless coding mode for an entire sequence or switches between coding modes on a frame-by-frame, block-by-block, tile-by-tile, or other basis.

The MUX 490 multiplexes the side information received from the other modules of the audio encoder 400 along with the entropy encoded data received from the entropy encoders 470, 474. The MUX 490 includes one or more buffers for rate control or other purposes.

D. Second Audio Decoder

With reference to FIG. 5, the second audio decoder 500 receives a bitstream 505 of compressed audio information. The bitstream 505 includes entropy encoded data as well as side information from which the decoder 500 reconstructs audio samples 595.

The DEMUX 510 parses information in the bitstream 505 and sends information to the modules of the decoder 500. The DEMUX 510 includes one or more buffers to compensate for short-term variations in bitrate due to fluctuations in complexity of the audio, network jitter, and/or other factors.

The entropy decoder 520 losslessly decompresses entropy codes received from the DEMUX 510, typically applying the inverse of the entropy encoding techniques used in the encoder 400. When decoding data compressed in lossy coding mode, the entropy decoder 520 produces quantized spectral coefficient data.

The mixed/pure lossless decoder 522 and associated entropy decoder(s) 520 decompress losslessly encoded audio data for the mixed/pure lossless coding mode.

The tile configuration decoder 530 receives and, if necessary, decodes information indicating the patterns of tiles for frames from the DEMUX 590. The tile pattern information may be entropy encoded or otherwise parameterized. The tile configuration decoder 530 then passes tile pattern information to various other modules of the decoder 500.

The inverse multi-channel transformer 540 receives the quantized spectral coefficient data from the entropy decoder 520 as well as tile pattern information from the tile configuration decoder 530 and side information from the DEMUX 510 indicating, for example, the multi-channel transform used and transformed parts of tiles. Using this information, the inverse multi-channel transformer 540 decompresses the transform matrix as necessary, and selectively and flexibly applies one or more inverse multi-channel transforms to the audio data.

The inverse quantizer/weighter 550 receives information such as tile and channel quantization factors as well as quantization matrices from the DEMUX 510 and receives quantized spectral coefficient data from the inverse multi-channel transformer 540. The inverse quantizer/weighter 550 decompresses the received weighting factor information as necessary. The quantizer/weighter 550 then performs the inverse quantization and weighting.

The inverse frequency transformer 560 receives the spectral coefficient data output by the inverse quantizer/weighter 550 as well as side information from the DEMUX 510 and tile pattern information from the tile configuration decoder 530. The inverse frequency transformer 570 applies the inverse of the frequency transform used in the encoder and outputs blocks to the overlapper/adder 570.

In addition to receiving tile pattern information from the tile configuration decoder 530, the overlapper/adder 570 receives decoded information from the inverse frequency transformer 560 and/or mixed/pure lossless decoder 522. The overlapper/adder 570 overlaps and adds audio data as necessary and interleaves frames or other sequences of audio data encoded with different modes.

The multi-channel post-processor 580 optionally re-matrixes the time-domain audio samples output by the overlapper/adder 570. For bitstream-controlled post-processing, the post-processing transform matrices vary over time and are signaled or included in the bitstream 505.

III. Encoder/Decoder With Band Partitioning And Varying Window Size

Figure 6:
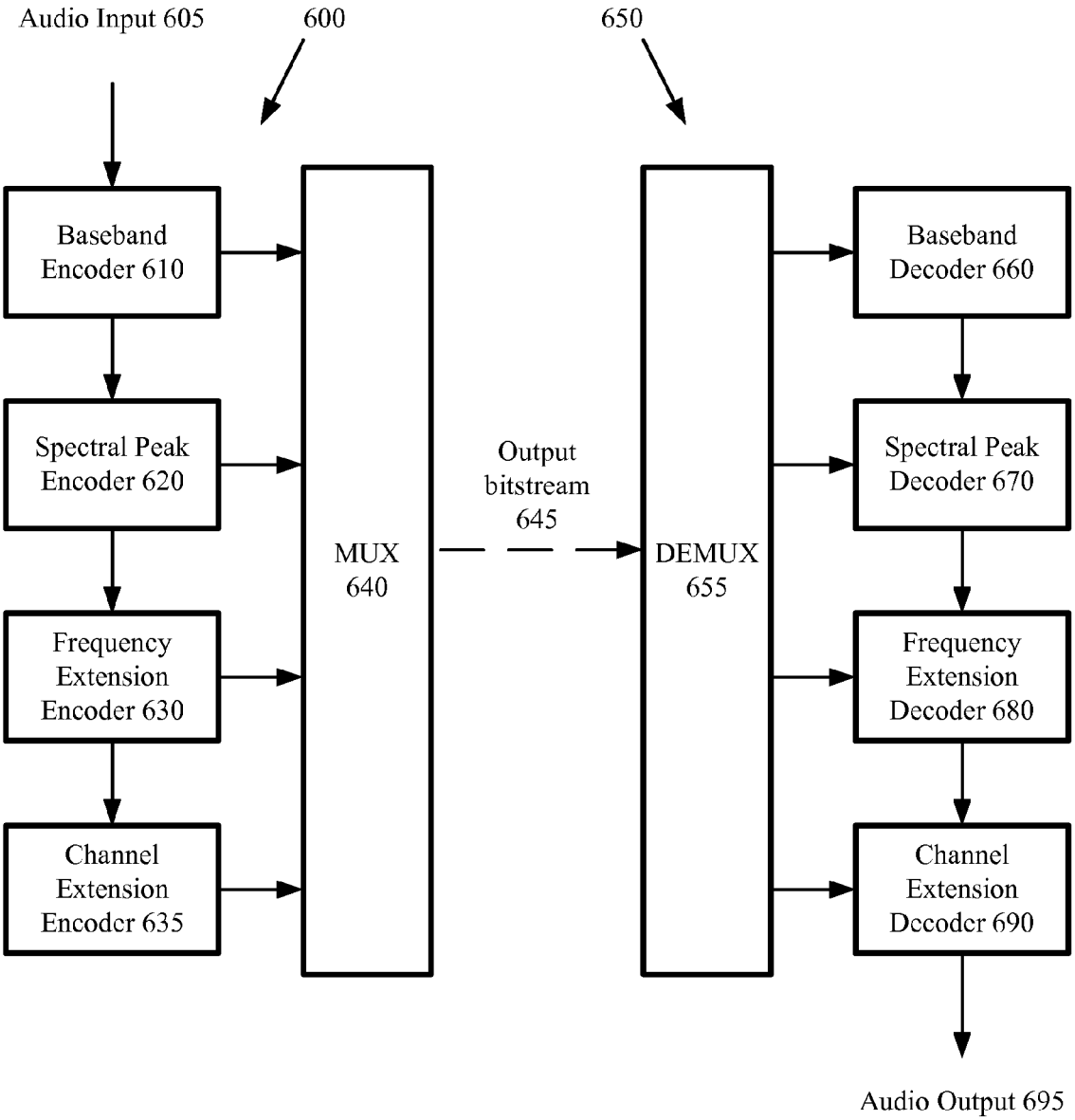
FIG. 6 is a data flow diagram of an audio encoding and decoding method that includes sparse spectral peak coding, and flexible frequency and time partitioning techniques.

FIG. 6 illustrates an extension of the above described transform-based, perceptual audio encoders/decoders of FIGS. 2-5 that further provides band partitioning for vector quantization of spectral holes and missing high frequency regions, as well as varying window size with vector quantization to improve time resolution when coding transients. As discussed in the Background above, the application of transform-based, perceptual audio encoding at low bit rates can produce transform coefficient data for encoding that may contain spectral holes and missing high frequency regions where quantization produces zero-value spectral coefficients. A band partitioning procedure described more fully below balances partitioning into bands for vector quantization between the spectral holes and high frequency region, so as to better preserve quality in the perceptually more significant high frequency region. A procedure to vary window size for vector quantization coding also is described below.

In the illustrated extension 600, an audio encoder 600 processes audio received at an audio input 605, and encodes a representation of the audio as an output bitstream 645. An audio decoder 650 receives and processes this output bitstream to provide a reconstructed version of the audio at an audio output 695. In the audio encoder 600, portions of the encoding process are divided among a baseband encoder 610, a spectral peak encoder 620, a frequency extension encoder 630 and a channel extension encoder 635. A multiplexor 640 organizes the encoding data produced by the baseband encoder, spectral peak encoder, frequency extension encoder and channel extension coder into the output bitstream 645.

On the encoding end, the baseband encoder 610 first encodes a baseband portion of the audio. This baseband portion is a preset or variable "base" portion of the audio spectrum, such as a baseband up to an upper bound frequency of 4 KHz. The baseband alternatively can extend to a lower or higher upper bound frequency. The baseband encoder 610 can be implemented as the above-described encoders 200, 400 (FIGS. 2, 4) to use transform-based, perceptual audio encoding techniques to encode the baseband of the audio input 605.

The spectral peak encoder 620 encodes the transform coefficients above the upper bound of the baseband using an efficient spectral peak encoding. This spectral peak encoding uses a combination of intra-frame and inter-frame spectral peak encoding modes. The intra-frame spectral peak encoding mode encodes transform coefficients corresponding to a spectral peak as a value trio of a zero run, and the two transform coefficients following the zero run (e.g., $(R,(L_0,L_1)))$. This value trio is further separately or jointly entropy coded. The inter-frame spectral peak encoding mode uses predictive encoding of a position of the spectral peak relative to its position in a preceding frame.

The frequency extension encoder 630 is another technique used in the encoder 600 to encode the higher frequency portion of the spectrum. This technique (herein called "frequency extension") takes portions of the already coded spectrum or vectors from a fixed codebook, potentially applying a non-linear transform (such as, exponentiation or combination of two vectors) and scaling the frequency vector to represent a higher frequency portion of the audio input. The technique can be applied in the same transform domain as the baseband encoding, and can be alternatively or additionally applied in a transform domain with a different size (e.g., smaller) time window.

The channel extension encoder 640 implements techniques for encoding multi-channel audio. This "channel extension" technique takes a single channel of the audio and applies a bandwise scale factor in a transform domain having a smaller time window than that of the transform used by the baseband encoder. The channel extension encoder derives the scale factors from parameters that specify the normalized correlation matrix for channel groups. This allows the channel extension decoder 680 to reconstruct additional channels of the audio from a single encoded channel, such that a set of complex second order statistics (i.e., the channel correlation matrix) is matched to the encoded channel on a bandwise basis.

On the side of the audio decoder 650, a demultiplexor 655 again separates the encoded baseband, spectral peak, frequency extension and channel extension data from the output bitstream 645 for decoding by a baseband decoder 660, a spectral peak decoder 670, a frequency extension decoder 680 and a channel extension decoder 690. Based on the information sent from their counterpart encoders, the baseband decoder, spectral peak decoder, frequency extension decoder and channel extension decoder perform an inverse of the respective encoding processes, and together reconstruct the audio for output at the audio output 695.

A. Band Partitioning

1. Encoding Procedure

Figure 7:
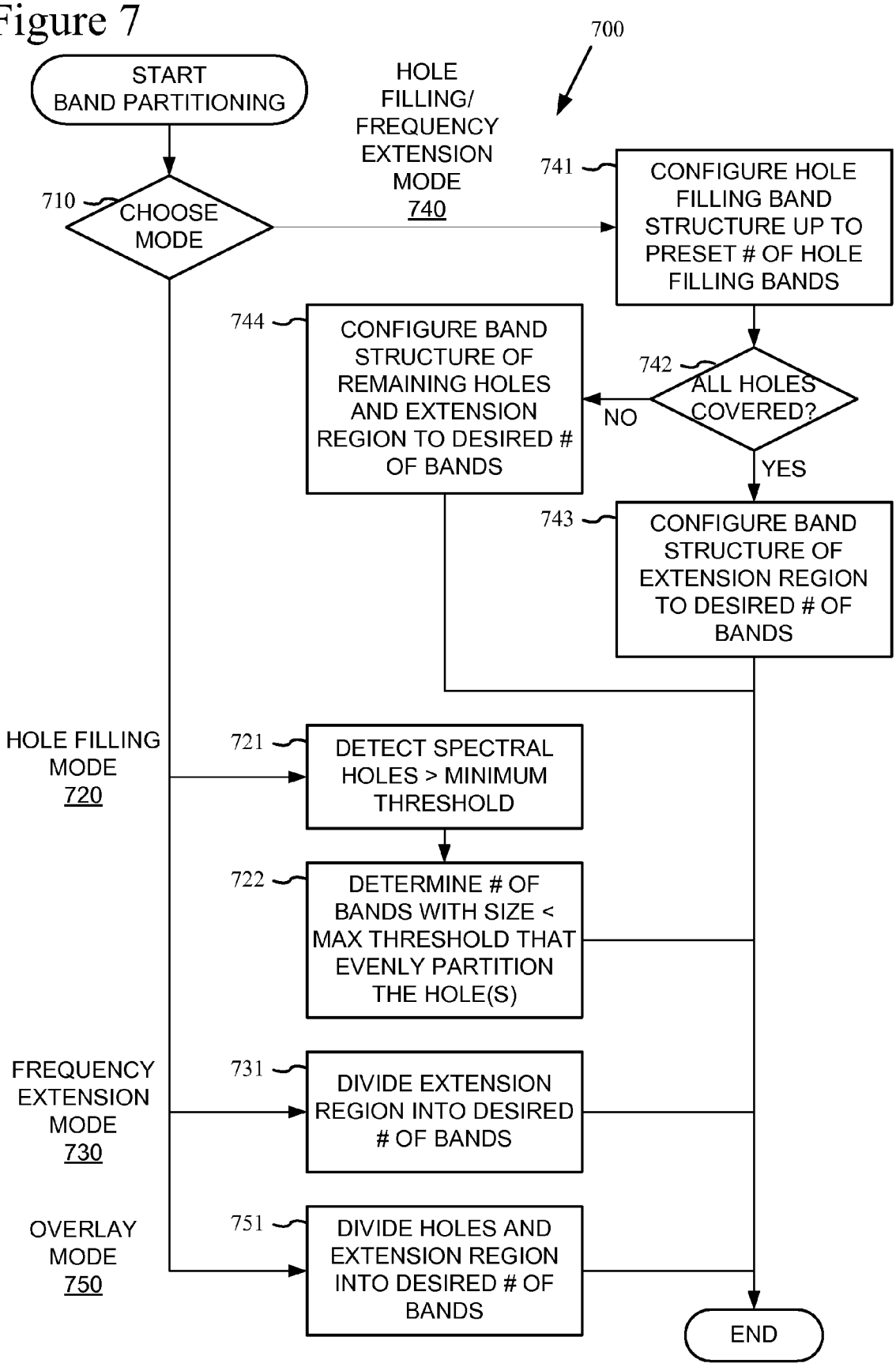
FIG. 7 is a flow diagram of a procedure for band partitioning of spectral hole and missing high frequency regions.

FIG. 7 illustrates a procedure 700 implemented by the frequency extension encoder 630 for partitioning any spectral holes and missing high frequency region into bands for vector quantization coding. The encoder 600 invokes this procedure to encode the transform coefficients that are determined to (or likely to) be missing in the high frequency region (i.e., above the baseband's upper bound frequency, which is 4 KHz in an example implementation) and/or form spectral holes in the baseband region. This is most likely to occur after quantization of the transform coefficients for low bit rate encoding, where more of the originally non-zero spectral coefficients are quantized to zero and form the missing high frequency region and spectral holes. The gaps between the base coding and sparse spectral peaks also are considered as spectral holes.

The band partitioning procedure 700 determines a band structure to cover the missing high frequency region and spectral holes using various band partitioning procedures. The missing spectral coefficients (both holes and higher frequencies) are coded in either the same transform domain or a smaller size transform domain. The holes are typically coded in the same transform domain as the base using the band partitioning procedure. Vector quantization in the base transform domain partitions the missing regions into bands, where each band is either a hole-filling band, overlay band, or a frequency extension band.

At start (decision step 710) of the band partitioning procedure 700, the encoder 600 chooses which of the band partitioning procedures to use. The choice of procedure can be based on the encoder first detecting the presence of spectral holes or missing high frequencies among the spectral coefficients encoded by the baseband encoder 610 and spectral peak encoder 620 for a current transform block of input audio samples. The presence of spectral holes in the spectral coefficients may be done, for example, by searching for runs of (originally non-zero) spectral coefficients that are quantized to zero level in the baseband region and that exceed a minimum length of run. The presence of a missing high frequency region can be detected based on the position of the last non-zero coefficients, the overall number of zero-level spectral coefficients in a frequency extension region (the region above the maximum baseband frequency, e.g., 4 KHz), or runs of zero-level spectral coefficients. In the case that the spectral coefficients contain significant spectral holes but not missing high frequencies, the encoder generally would choose the hole filling procedure 720. Conversely, in the case of missing high frequencies but few or no spectral holes, the encoder generally would choose the frequency extension procedure 730. If both spectral holes and missing high frequencies are present, the encoder generally uses hole filling, overlay and frequency extension bands. Alternatively, the band partitioning procedure can be determined based simply on the selected bit rate (e.g., the hole filling and frequency extension procedure 740 is appropriate to very low bit rate encoding, which tends to produce both spectral holes and missing high frequencies), or arbitrarily chosen.

In the hole filling procedure 720, the encoder 600 uses two thresholds to manage the number of bands allocated to fill spectral holes, which include a minimum hole size threshold and a maximum band size threshold. At a first action 721, the encoder detects spectral holes (i.e., a run of consecutive zero-level spectral coefficients in the baseband after quantization) that exceed the minimum hole size threshold. For each spectral hole over the minimum threshold, the encoder then evenly partitions the spectral hole into a number of bands, such that the size of the bands is equal to or smaller than a maximum band size threshold (action 722). For example, if a spectral hole has a width of 14 coefficients and the maximum band size threshold is 8, then the spectral hole would be partitioned into two bands having a width of 7 coefficients each. The encoder can then signal the resulting band structure in the compressed bit stream by coding two thresholds.

In the frequency extension procedure 730, the encoder 600 partitions the missing high frequency region into separate bands for vector quantization coding. As indicated at action 731, the encoder divides the frequency extension region (i.e., the spectral coefficients above the upper bound of the base band portion of the spectrum) into a desired number of bands. The bands can be structured such that successive bands are related by a ratio of their band size that is binary-increased, linearly-increased, or an arbitrary configuration.

In the overlay procedure 750, the encoder partitions both spectral holes (with size greater than the minimum hole threshold) and the missing high frequency region into a band structure using the frequency extension procedure 730 approach. In other words, the encoder partitions the holes and high frequency region into a desired number of bands that have a binary-increasing band size ratio, linearly-increasing band size ratio, or arbitrary configuration of band sizes.

Finally, the encoder can choose a fourth band partitioning procedure called the hole filling and frequency extension procedure 740. In the hole filling and frequency extension procedure 740, the encoder 600 partitions both spectral holes and the missing high frequency region into a band structure for vector quantization coding. First, as indicated by block 741, the encoder 600 configures a band structure to fill any spectral holes. As with the hole filling procedure 720 via the actions 721, 722, the encoder detects any spectral holes larger than a minimum hole size threshold. For each such hole, the encoder allocates a number of bands with size less than a maximum band size threshold in which to evenly partition the spectral hole. The encoder halts allocating bands in the band structure for hole filling upon reaching the preset number of hole filling bands. The decision step 742 checks if all spectral holes are filled by the action 741 (hole filling procedure). If all spectral holes are covered, the action 743 then configures a band structure for the missing high frequency region by allocating a desired total number of bands minus the number of bands allocated as hole filling bands, as with the frequency extension procedure 730 via the action 731. Otherwise, the whole of the unfilled spectral holes and missing high frequency region is partitioned to a desired total number of bands minus the number of bands allocated as hole filling bands by the action 744 as with the overlay procedure 750 via the action 751. Again, the encoder can choose a band size ratio of successive bands used in the actions 743, 744, from binary increasing, linearly increasing, or an arbitrary configuration.

B. Varying Transform Window Size With Vector Quantization

1. Encoding Procedure

Figure 8:
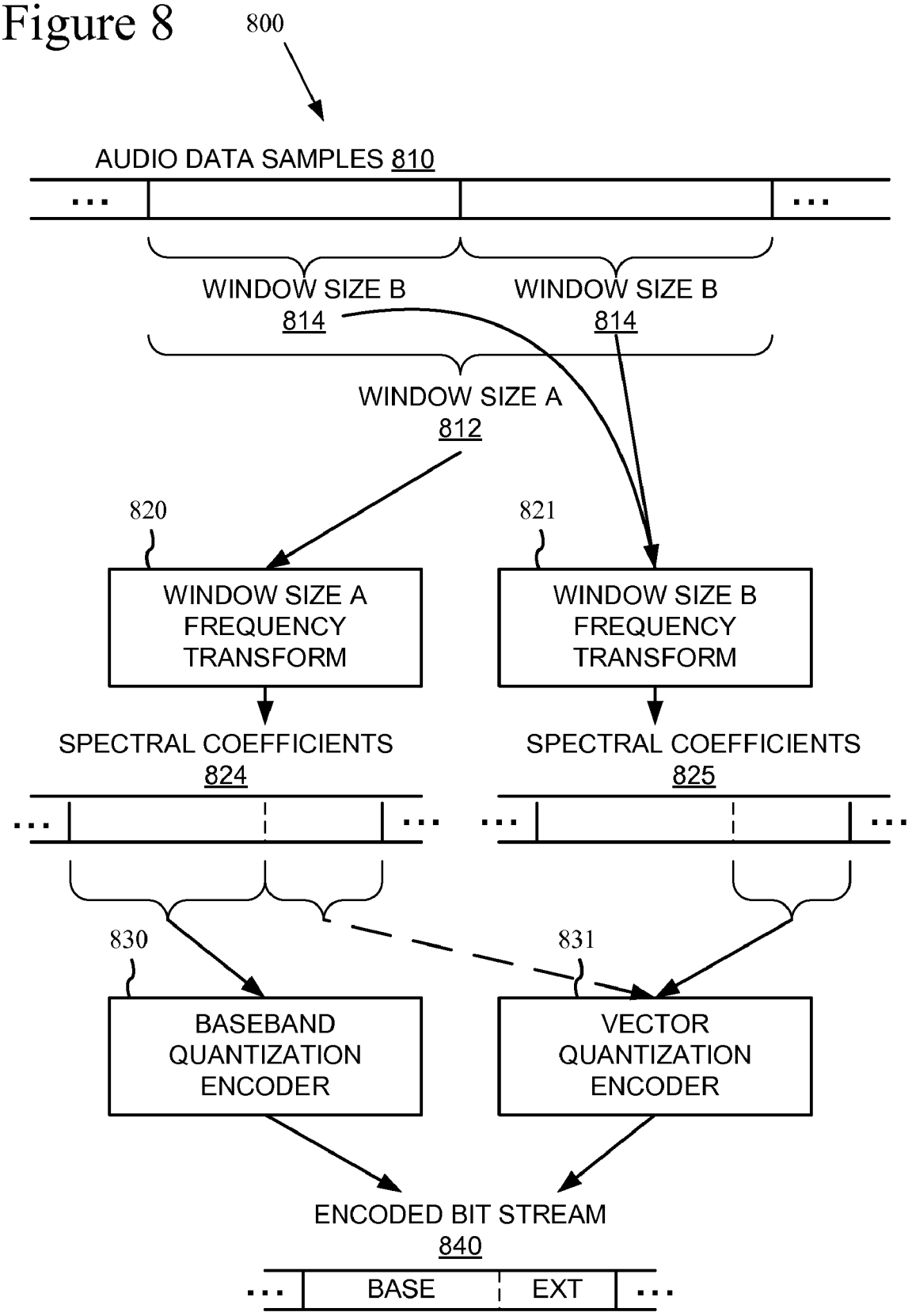
FIG. 8 is a flow diagram of a procedure for encoding using vector quantization with varying transform block ("window") sizes to adapt time resolution of transient versus tonal sounds.

FIG. 8 illustrates an encoding procedure 800 for combining vector quantization coding with varying window (transform block) sizes. As remarked above, an audio signal generally consists of stationary (typically tonal) components as well as "transients." The tonal components desirably are encoded using a larger transform window size for better frequency resolution and compression efficiency, while a smaller transform window size better preserves the time resolution of the transients. The procedure 800 provides a way to combine vector quantization with such transform window size switching for improved time resolution when coding transients.

With the encoding procedure 800, the encoder 600 (FIG. 6) can flexibly combine use of normal quantization coding and vector quantization coding at potentially different transform window sizes. In an example implementation, the encoder chooses from the following coding and window size combinations:

1. In a first alternative combination, the normal quantization coding is applied to a portion of the spectrum (e.g., the "baseband" portion) using a wider transform window size ("window size A" 812). Vector quantization coding also is applied to part of the spectrum (e.g., the "extension" portion) using the same wide window size A 812. As shown in FIG. 8, a group of the audio data samples 810 within the window size A 812 are processed by a frequency transform 820 appropriate to the width of window size A 812. This produces a set of spectral coefficients 824. The baseband portion of these spectral coefficients 824 is coded using the baseband quantization encoder 830, while an extension portion is encoded by a vector quantization encoder 831. The coded baseband and extension portions are multiplexed into an encoded bit stream 840.

2. In a second alternative combination, the normal quantization is applied to part of the spectrum (e.g., the "baseband" portion) using the window size A 812, while the vector quantization is applied to another part of the spectrum (such as the high frequency "extension" region) with a narrower window size B 814. In this example, the narrower window size B is half the width of the window size A. Alternatively, other ratios of wider and narrower window sizes can be used, such as 1:4, 1:8, 1:3, 2:3, etc. As shown in FIG. 8, a group of audio samples within the window size A are processed by window size A frequency transform 820 to produce the spectral coefficients 824. The audio samples within the narrower window size B 814 also are transformed using a window size B frequency transform 821 to produce spectral coefficients 825. The baseband portion of the spectral coefficients 824 produced by the window size A frequency transform 820 are encoded via the baseband quantization encoder 830. The extension region of the spectral coefficients 825 produced by the window size B frequency transform 821 are encoded by the vector quantization encoder 831. The coded baseband and extension spectrum are multiplexed into the encoded bit stream 840.

3. In a third alternative combination, the normal quantization is applied to part of the spectrum (e.g., the "baseband" region) using the window size A 812, while the vector quantization is applied to another part of the spectrum (e.g., the "extension" region) also using the window size A. In addition, another vector quantization coding is applied to part of the spectrum with window size B 814. As illustrated in FIG. 8, the audio sample 810 within a window size A 812 are processed by a window size A frequency transform 820 to produce spectral coefficients 824, whereas audio samples in block of window size B 814 are processed by a window size B frequency transform 821 to produce spectral coefficients 825. A baseband part of the spectral coefficients 824 from window size A are coded using the baseband quantization encoder 830. An "extension" region of the spectrum of both spectral coefficients 824 and 825 are encoded via a vector quantization encoder 831. The coded baseband and extension spectral coefficients are multiplexed into the encoded bit stream 840. Although the illustrated example applies the normal quantization and vector quantization to separate regions of the spectrum, the parts of the spectrum encoded by each of the three quantization coding can overlap (i.e., be coincident at the same frequency location).

Figure 9:
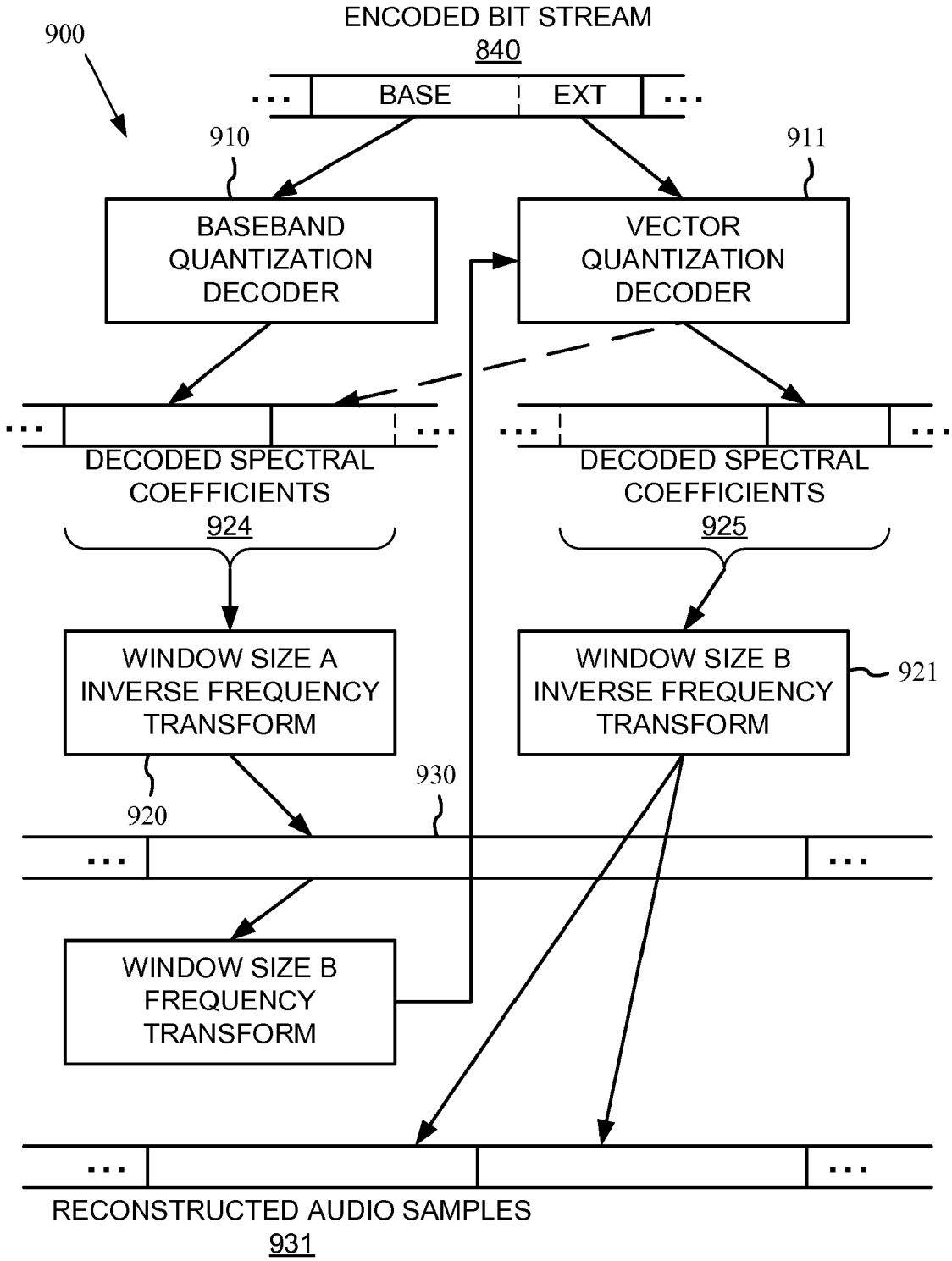
FIG. 9 is a flow diagram of a procedure for decoding using vector quantization with varying transform block ("window") sizes to adapt time resolution of transient versus tonal sounds.

With reference now to FIG. 9, a decoding procedure 900 decodes the encoded bit stream 840 at the decoder. The encoded baseband and extension data are separated from the encoded bit stream 840 and decoded by the baseband quantization decoder 910 and vector quantization decoder 911. The baseband quantization decoder 910 applies an inverse quantization process to the encoded baseband data to produce decoded baseband portion of the spectral coefficients 924. The vector quantization decoder 911 applies an inverse vector quantization process to the extension data to produce decoded extension portion for both the spectral coefficients 924, 925.

In the case of the first alternative combination, both the baseband and extension were encoded using the same window size A 812. Therefore, the decoded baseband and decoded extension form the spectral coefficients 924. An inverse frequency transform 920 with window size A is then applied to the spectral coefficients 924. This produces a single stream of reconstructed audio samples, such that no summing or transform to window size B transform domain of reconstructed audio sample for separate window size blocks is needed.

Otherwise, in the case of the second alternative combination, the window size A inverse frequency transform 920 is applied to the decoded baseband coefficients 924, while a window size B inverse frequency transform 921 is applied to the decoded extension coefficients 925. This produces two sets of audio samples in blocks of window size A 930 and window size B 931, respectively. However, the baseband region coefficients are needed for the inverse vector quantization. Accordingly, prior to the decoding and inverse transform using the window size B, the window size B forward transform 821 is applied to the window size A blocks of reconstructed audio samples 930 to transform into the transform domain of window size B. The resulting baseband spectral coefficients are combined by the vector quantization decoder to reconstruct the full set of spectral coefficients 925 in the window size B transform domain. The window size B inverse frequency transform 921 is applied to this set of spectral coefficients to form the final reconstructed audio sample stream 931.

In the case of the third alternative combination, the vector quantization was applied to both the spectral coefficients in the extension region for the window size A and window size B transforms 820 and 821. Accordingly, the vector quantization decoder 911 produces two sets of decoded extension spectral coefficients: one encoded from the window size A transform spectral coefficients and one for the window size B spectral coefficients. The window size A inverse frequency transform 920 is applied to the decoded baseband coefficients 924, and also applied to the decoded extension spectral coefficients for window size A to produce window size A blocks of audio samples 930. Again, the baseband coefficients are needed for the window size B inverse vector quantization. Accordingly, the window size B frequency transform 821 is applied to the window size A blocks of reconstructed audio samples to convert to the window size B transform domain. The window size B vector quantization decoder 911 uses the converted baseband coefficients, and as applicable, sums the extension region spectral coefficients to produce the decoded spectral coefficients 925. The window size B inverse frequency transform 921 is applied to those decoded extension spectral coefficients to produce the final reconstructed audio samples 931.

C. Band Structure Syntax

The following coding syntax table illustrates one possible coding syntax for signaling the band structure used with the band partitioning coding procedure 700 (FIG. 7) in the illustrated encoder 600/decoder 650 (FIG. 6). This coding syntax can be varied for other alternative implementations of the band partitioning technique. In the following syntax tables, the use of uniform band structure, binary increasing and linearly increasing band size ratio, and arbitrary configurations discussed above are signaled.

TABLE 1

| Syntax | # bits |
|---|---|
| freqexDecodeBandConfig( ) | |
| { | |
| iConfig=0 | |
| iChannelRem=cMvChannel | |
| while( 1 ) | |
| { | |
| bUseUniformBands[iConfig] | 1 |
| bArbitraryBandConfig[iConfig] | 1 |
| if(bUseUniformBands[iConfig] \|\| | |
| bArbitraryBandConfig[iConfig]) | |
| cScaleBands | [LOG2(cMaxBands) + 1] |
| Else | |
| cScaleBands | [LOG2(cMaxBands)] |
| if (bArbitraryBandConfig[iConfig]) | |
| { | |
| iMinRatioBandSizeM | 1-3 |
| freqexDecodeBandSizeM( ) | |
| } | |
| if (iChannelRem==1) | |
| bApplyToAllRemChannel=1 | |
| Else | |
| bApplyToAllRemChannel | 1 |
| for (iCh=0; iCh<cMvChannel; iCh++) | |
| { | |
| if (iCh is not coded) | |
| { | |
| if (!bApplyToAllRemChannel | |
| ) | |

TABLE 1-continued

| Syntax | # bits |
|---|---|
| bApplyToThisChannel | 1 |
| if (bApplyToAllRemChannel || bApplyToThisChannel) | |
| iChannelRem−− | |
| } | |
| } | |
| if (iChannelRem==0) | |
| break; | |
| iConfig++ | |
| } | |
| } | |

TABLE 2

| [Recon - GrpA] ScBandSplit/NumBandCoding | | | | | |
|---|---|---|---|---|---|
| 00: | B-2D | 100: | B-1D | 110: | AU-1D |
| 01: | L-2D | 101: | L-1D | 111: | AU-2D |
| [Coding - GrpA] ScBandSplit/NumBandCoding | | | | | |
| 00: | B-1D | 100: | B-2D | 110: | AU-1D |
| 01: | L-1D | 101: | L-2D | 111: | AU-2D |

B - BinarySplit
1D - Sc = Mv
L - Linear Split
2D - Sc/Mv
AU - Arbitrary/Uniform Split

TABLE 3

| <Update Group> | |
|---|---|
| 0: | No Update |
| 100: | All Update |
| 101: | GrpA |
| 1100: | GrpB |
| 1101: | GrpC |
| 1110: | GrpA + GrpB |
| 1111: | GrpA + GrpB + GrpC |

D. Example Coded Audio

Figure 10:
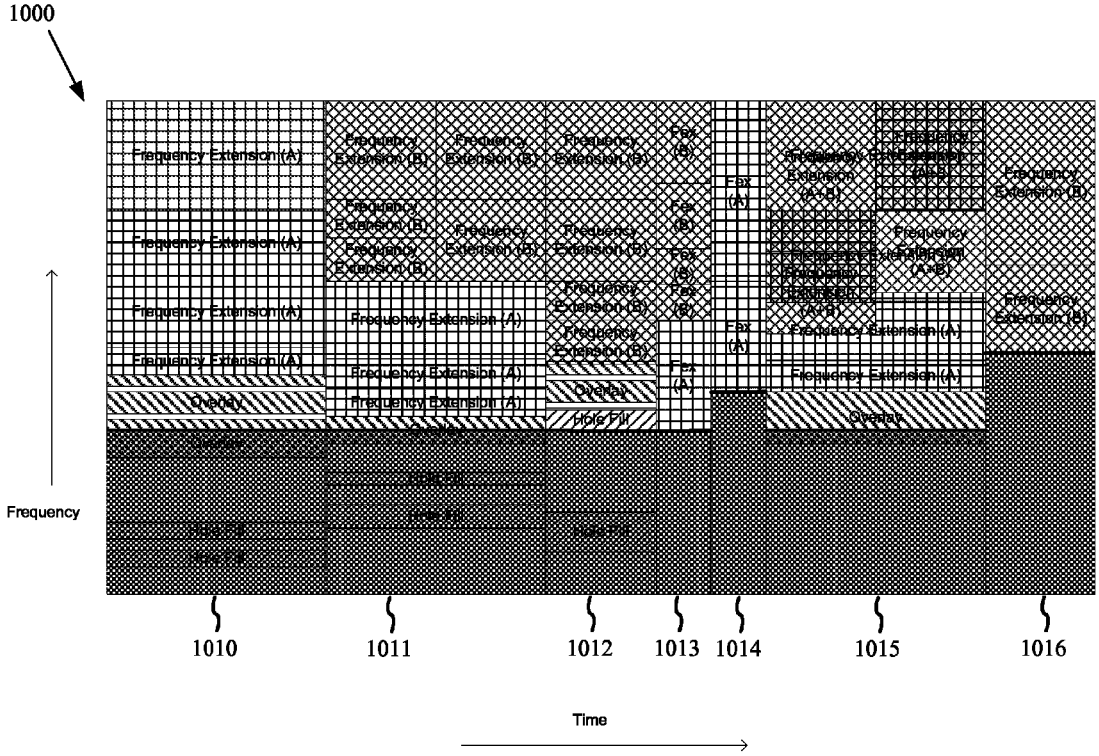
FIG. 10 is a diagram depicting coding techniques applied to various regions of an example audio stream.

FIG. 10 illustrates how various coding techniques are applied to spectral regions of an audio example. The diagram shows the coding techniques applied to spectral regions for 7 base tiles 1010-1016 in the encoded bit stream.

The first tile 1010 has two sparse spectral peaks coded beyond the base. In addition, there are spectral holes in the base. Two of these holes are filled with the hole-filling mode. Suppose the maximum number of hole-filling bands is 2. The final spectral holes in the base are filled with the overlay mode of the frequency extension. The spectral region between the base and the sparse spectral peaks is also filled with the overlay mode bands. After the last band which is used to fill the gaps between the base and sparse spectral peaks, regular frequency extension with the same transform size as the base is used to fill in the missing high frequencies.

The hole-filling is used on the second tile 1011 to fill spectral holes in the base (two of them). The remaining spectral holes are filled with the overlay band which crosses over the base into the missing high spectral frequency region. The remaining missing high frequencies are coded using frequency extension with the same transform size used to code the lower frequencies (where the tonal components happen to be), and a smaller transform size frequency extension used to code the higher frequencies (For the transients).

For the third tile 1012, the base region has one spectral hole only. Beyond the base region there are two coded sparse spectral peaks. Since there is only one spectral hole in the base, the gap between the last base coded coefficient and the first sparse spectral peak is coded using a hole-filling band. The missing coefficients between the first and second sparse spectral peak and beyond the second peak are coded using and overlay band. Beyond this, regular frequency extension using the small size frequency transform is used.

The base region of the fourth tile 1013 has no spectral peaks. Frequency extension is done in the two transform domains to fill in the missing higher frequencies.

The fifth tile 1014 is similar to the fourth tile 1013, except only the base transform domain is used.

For the sixth tile 1015, frequency extension coding in the same transform domain is used to code the lower frequencies and the tonal components in the higher frequencies. Transient components in higher frequencies are coded using a smaller size transform domain. Missing high frequency components are obtained by summing the two extensions.

The seventh tile 1016 also is similar to the fourth tile 1013, except the smaller transform domain is used.

In view of the many possible embodiments to which the principles of our invention may be applied, we claim as our invention all such embodiments as may come within the scope and spirit of the following claims and equivalents thereto.

We claim:

1. A method of compressively encoding audio, the method comprising:

applying a frequency transform to blocks of input audio data to produce sets of spectral coefficients;

quantizing the sets of spectral coefficients;

encoding quantized spectral coefficients in a base frequency region of the sets up to an upper bound frequency position in a compressed audio bit stream;

determining a band structure for partitioning spectral holes and an extension region above the upper bound frequency position into bands for vector quantization coding, where the spectral holes are runs of consecutive spectral coefficients in the base frequency region that were quantized to a zero value;

wherein said determining a band structure for partitioning in the case of spectral holes comprises:

detecting any spectral holes in the base frequency region having a width larger than a minimum hole size threshold; and for a detected spectral hole, determining a number of bands having a band size not exceeding a maximum band size threshold and that evenly divide the detected spectral hole; and encoding spectral coefficients at the frequency positions of the spectral holes and the extension region using vector quantization coding in the compressed audio bit stream.

2. The method of claim 1 wherein said determining a band structure for partitioning in the case of spectral holes further comprises configuring bands in the band structure in which to partition spectral holes up to a predetermined maximum number of spectral hole filling bands.

3. The method of claim 1 wherein said determining a band structure for partitioning in the case of the extension region comprises:

dividing the extension region into a desired number of bands.

4. The method of claim 3 wherein said determining a band structure for partitioning in the case of the extension region further comprises:

dividing the extension region into bands having a binary-increasing ratio, linearly-increasing ratio, or arbitrary configuration of band sizes.

5. The method of claim 1 further comprising choosing a band partitioning mode from among a hole filling mode in which the band structure partitions the spectral holes only, an extension mode in which the band structure partitions the extension region only, and a hole filling and extension mode in which the band structure partitions the spectral holes and extension region.

6. The method of claim 5 wherein said choosing the band partitioning mode further comprises choosing from among modes further comprising an overlay mode in which the band structure partitions the spectral holes and extension region, and wherein said determining the band structure when the overlay mode is chosen comprises dividing the spectral holes and extension region into a desired number of bands having a binary-increasing ratio, linearly-increasing ratio, or arbitrary configuration of band sizes.

7. A method of decoding the compressed audio bit stream of claim 1 comprising:

decoding the spectral coefficients of the base region from the compressed audio bit stream;

determining the band structure of the spectral holes and extension region;

decoding the spectral coefficients of the spectral holes and extension region;

applying inverse quantization to the spectral coefficients of the based region and inverse vector quantization to the spectral coefficients of the spectral holes and extension region for the determined band structure;

combining the spectral coefficients of the base region, spectral holes and extension region; and applying an inverse transform to the combined spectral coefficients to produce reconstructed audio.

8. Computer readable memory device comprising computer-executable instructions for performing a method that comprises:

applying a frequency transform to blocks of input audio data to produce sets of spectral coefficients;

quantizing the sets of spectral coefficients;

encoding quantized spectral coefficients in a base frequency region of the sets up to an upper bound frequency position in a compressed audio bit stream;

determining a band structure for partitioning spectral holes and an extension region above the upper bound frequency position into bands for vector quantization coding, where the spectral holes are runs of consecutive spectral coefficients in the base frequency region that were quantized to a zero value;

wherein said determining a band structure for partitioning in the case of spectral holes comprises:

detecting any spectral holes in the base frequency region having a width larger than a minimum hole size threshold; and for a detected spectral hole, determining a number of bands having a band size not exceeding a maximum band size threshold and that evenly divide the detected spectral hole; and encoding spectral coefficients at the frequency positions of the spectral holes and the extension region using vector quantization coding in the compressed audio bit stream.

9. The computer readable memory device of claim 8, wherein said determining a band structure for partitioning in the case of spectral holes further comprises configuring bands in the band structure in which to partition spectral holes up to a predetermined maximum number of spectral hole filling bands.

10. The computer readable memory device of claim 8, wherein said determining a band structure for partitioning in the case of the extension region comprises dividing the extension region into a desired number of bands.

11. The computer readable memory device of claim 10, wherein said determining a band structure for partitioning in the case of the extension region further comprises dividing the extension region into bands having a binary-increasing ratio, linearly-increasing ratio, or arbitrary configuration of band sizes.

12. The computer readable memory device of claim 8, wherein the method further comprises choosing a band partitioning mode from among a hole filling mode in which the band structure partitions the spectral holes only, an extension mode in which the band Structure partitions the extension region only, and a hole filling and extension mode in which the band structure partitions the spectral holes and extension region.

13. The computer readable memory device of claim 12, wherein said choosing the band partitioning mode further comprises choosing from among modes further comprising an overlay mode in which the band structure partitions the spectral holes and extension region, and wherein said determining the band structure when the overlay mode is chosen comprises dividing the spectral holes and extension region into a desired number of bands having a binary-increasing ratio, linearly-increasing ratio, or arbitrary configuration of band sizes.

14. The computer readable memory device of claim 8, further comprising computer-executable instructions for a method of decoding the compressed audio bi stream, wherein the method of decoding comprises:

decoding the spectral coefficients of the base region from the compressed audio bit steam;

determining the band structure of the spectral holes and extension region;

decoding the spectral coefficients of the spectral holes and extension region;

applying inverse quantization to the spectral coefficients of the based region and inverse vector quantization to the spectral coefficients of the spectral holes and extension region for the determined band structure;

combining the spectral coefficients of the base region, spectral holes and extension region; and applying an inverse transform to the combined spectral coefficients to produce reconstructed audio.

15. An audio coder, comprising at least one processor configured to:

apply a frequency transform to blocks of input audio data to produce sets of spectral coefficients;

quantize the sets of spectral coefficients;

encode quantized spectral coefficients in a base frequency region of the sets up to an upper bound frequency position in a compressed audio bit stream;

determine a band structure for partitioning spectral holes and an extension region above the upper bound frequency position into bands for vector quantization coding, where the spectral holes are runs of consecutive spectral coefficients in the base frequency region that were quantized to a zero value;

wherein said determining a band structure for partitioning in the case of spectral holes comprises:

detecting any spectral holes in the base frequency region having a width larger than a minimum hole size threshold; and for a detected spectral hole, determining a number of bands having a band size not exceeding a maximum band size threshold and that evenly divide the detected spectral hole; and encode spectral coefficients at the frequency positions of the spectral holes and the extension region using vector quantization coding in the compressed audio bit stream.

16. The audio coder of claim 15, wherein the processor is configured to determine the band structure for partitioning in the case of spectral holes by configuring bands in the band structure in which to partition spectral holes up to a predetermined maximum number of spectral hole filling bands.

17. The audio coder of claim 15, wherein the processor is configured to determine a band structure for partitioning in the case of the extension region by dividing the extension region into a desired number of bands.

18. The audio coder of claim 17, wherein the processor is configured to determine a band structure for partitioning in the case of the extension region by dividing the extension region into bands having a binary-increasing ratio, linearly-increasing ratio, or arbitrary configuration of band sizes.

19. The audio coder of claim 15, wherein the processor is configured to choose a band partitioning mode from among a hole filling mode in which the band structure partitions the spectral holes only, an extension mode in which the band structure partitions the extension region only, and a hole filling and extension mode in which the band structure partitions the spectral holes and extension region.

20. The audio coder of claim 19, wherein the processor is configured to choose the band partitioning mode by choosing from among modes that include an overlay mode in which the band structure partitions the spectral holes and extension region, and wherein said determining the band structure when the overlay mode is chosen comprises dividing the spectral holes and extension region into a desired number of bands having a binary-increasing ratio, linearly-increasing ratio, or arbitrary configuration of band sizes.

21. The audio coder of claim 15, wherein the processor is configured to decode the compressed audio bit stream by:

decoding the spectral coefficients of the base region from the compressed audio bit stream;

determining the band structure of the spectral holes and extension region;

decoding the spectral coefficients of the spectral holes and extension region;

applying inverse quantization to the spectral coefficients of the based region and inverse vector quantization to the spectral coefficients of the spectral holes and extension region for the determined band structure;

combining the spectral coefficients of the base region, spectral holes and extension region; and applying an inverse transform to the combined spectral coefficients to produce reconstructed audio.

* * * * *

UNITED STATES PATENT AND TRADEMARK OFFICE

CERTIFICATE OF CORRECTION

PATENT NO. : 7,761,290 B2
APPLICATION NO. : 11/764134
DATED : July 20, 2010
INVENTOR(S) : Kazuhito Koishida et al.

It is certified that error appears in the above-identified patent and that said Letters Patent is hereby corrected as shown below:

In column 20, line 35, in Claim 14, delete “bi” and insert -- bit --, therefor.

In column 20, line 38, in Claim 14, delete “steam” and insert -- stream --, therefor.

Signed and Sealed this
Twenty-ninth Day of March, 2011

David J. Kappos

David J. Kappos
*Director of the United States Patent and Trademark Office*